US008033129B2

(12) United States Patent
Koike et al.

(10) Patent No.: US 8,033,129 B2
(45) Date of Patent: Oct. 11, 2011

(54) SHOWCASE

(75) Inventors: Yasuhide Koike, Toyoake (JP); Tatsuo Saeki, Toyoake (JP); Takatoshi Torihata, Toyoake (JP); Tomio Suyama, Toyoake (JP); Tsuyoshi Shima, Toyoake (JP); Toshiaki Hara, Toyoake (JP); Masaki Okada, Toyoake (JP); Michiya Abe, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 236 days.

(21) Appl. No.: 11/918,159

(22) PCT Filed: Jul. 3, 2006

(86) PCT No.: PCT/JP2006/313238

§ 371 (c)(1), (2), (4) Date: Oct. 10, 2007

(87) PCT Pub. No.: WO2007/004615

PCT Pub. Date: Jan. 11, 2007

(65) Prior Publication Data

US 2009/0019873 A1 Jan. 22, 2009

(30) Foreign Application Priority Data

| | | |
|---|---|---|
| Jul. 4, 2005 | (JP) | 2005-195548 |
| Sep. 29, 2005 | (JP) | 2005-285052 |
| Jan. 18, 2006 | (JP) | 2006-010430 |
| Apr. 24, 2006 | (JP) | 2006-119692 |

(51) Int. Cl.
*F25D 23/00* (2006.01)
*A47F 3/04* (2006.01)

(52) U.S. Cl. ..... 62/264; 62/246

(58) Field of Classification Search ..... 62/264, 62/246–256; 362/125, 127; 312/223.5
See application file for complete search history.

(56) References Cited

U.S. PATENT DOCUMENTS

| | | | | |
|---|---|---|---|---|
| 2,025,997 | A * | 12/1935 | McMillan | 62/290 |
| 4,949,554 | A * | 8/1990 | Branz et al. | 62/248 |
| 6,578,979 | B2 * | 6/2003 | Truttmann-Battig | 362/92 |
| 6,915,652 | B2 * | 7/2005 | Lane et al. | 62/246 |
| 7,121,675 | B2 * | 10/2006 | Ter-Hovhannisian | 362/92 |

FOREIGN PATENT DOCUMENTS

JP 8-327209 12/1996

(Continued)

*Primary Examiner* — Frantz Jules
*Assistant Examiner* — Cassey D Bauer
(74) *Attorney, Agent, or Firm* — DLA Piper LLP (US)

(57) ABSTRACT

A showcase where an illumination device is placed outside a receiving chamber to enable effective use of the space in the receiving chamber. The inside of an insulated box body (16) having front glass (18) fitted in a front opening (56) is defined to form a receiving chamber (52). An upper evaporator (34) is placed in an upper insulating layer (54) of the insulated box body (16) so as to be in contact with a cooling plate (62) defining the upper surface of the receiving chamber (52). An opening (64) is formed in that portion of the cooling plate (62) with which the upper evaporator (34) is not in contact, and a receiving space (66) is formed in that portion of the upper insulating layer (54) to which the opening (64) faces. A holder (78) is placed at the receiving space (66), and inside the holder (78) is received and fixed an LED illumination device (70). The opening (64) is closed by a cover (86) with packing (84) in between, and the inside of the holder (78) is maintained in a sealed state.

4 Claims, 24 Drawing Sheets

FOREIGN PATENT DOCUMENTS

| | | |
|---|---|---|
| JP | 11-83282 | 3/1999 |
| JP | 2001-336868 | 12/2001 |
| JP | 2003-79488 | 3/2003 |
| JP | 2004-309022 | 11/2004 |

* cited by examiner

SHOWCASE

TECHNICAL FIELD

The present invention relates to a showcase which, when placed on a counter in a restaurant, a bar or the like, preserves goods stored therein while displaying the goods.

BACKGROUND ART

As a refrigerated showcase which refrigerates goods, such as foods and beverages, for preservation, there is a so-called showcase which is placed on a counter in, for example, a sushi bar, refrigerates and preserves fresh food materials like sushi materials stored therein, while displaying them (see Patent Document 1). As shown in FIGS. 23 and 24, for example, a refrigerated showcase 10 has a storage room 12 to refrigerate goods for preservation, and a machine room 14, provided adjacent to each other. A cooling unit, such as a compressor and an evaporator (neither shown), for cooling the storage room 12 is disposed in the machine room 14. The storage room 12 is defined inside an insulated box body 16 having a heat insulating structure with an insulating material 32, such as urethane foam, filled between an outer covering and an inner covering, and a front glass 18 is fitted in a front opening 56 formed at the front surface of the insulated box body 16 to show the interior of the storage room 12 from the front side.

As shown in FIG. 24, a goods doorway 20 with respect to the storage room 12 is formed at the rear surface of the insulated box body 16, and slide doors 22 are slidably mounted to the goods doorway 20, so that as the goods doorway 20 is opened by sliding the slide doors 22 leftward or rightward, goods are permitted to be taken in or out of the storage room 12.

A cooling plate 30 is disposed under an upper insulating layer 26 formed at the upper side of the storage room 12 in the insulated box body 16. An upper evaporator 34 connected to the cooling unit is disposed inside the upper insulating layer 26 in such a way as to contact the cooling plate 30, so that the coolant which is circulated to the upper evaporator 34 cools the cooling plate 30, thereby intermittently cooling the storage room 12.

A fluorescent lamp 36 as an illumination device is mounted to the upper portion of the storage room 12 by an illumination support 38 secured to the cooling plate 30. This fluorescent lamp 36 is protected by a transparent resin cover 40 to prevent degradation originating from electric leakage or rust which is caused by water splash at the time of washing, and prevent a food material container or the like from being broken by contact with the fluorescent lamp 36 at the time the container is placed in or out of the storage room 12. The fluorescent lamp 36 is set apart from the cooling plate 30 by a predetermined distance by the illumination support 38 to secure the heat exchange area of the cooling plate 30.

[Patent Document 1: Japanese Patent Application Laid-Open No. Heisei 8-327209

DISCLOSURE OF INVENTION

Problems to be Solved by the Invention

While the conventional refrigerated showcase 10 employs the fluorescent lamp 36 as an illumination device to illuminate the storage room 12, as mentioned above, the fluorescent lamp 36 is set apart from the cooling plate 30 by a predetermined distance to secure the heat exchange area of the cooling plate 30. Therefore, the volume of the storage room 12 becomes smaller by the projection of the fluorescent lamp 36. This may disable the effective use of the space of the storage room 12 or may result in a case where the fluorescent lamp 36 interferes with storage of large food materials. What is more, the fluorescent lamp 36, when in use, generates heat which warms the storage room 12. In this respect, the conventional refrigerated showcase 10 uses a large-volume cooling unit to hold the storage room 12 in a low-temperature state, which leads to an increase in the running cost for the refrigerated showcase 10. Further, the long use of the fluorescent lamp 36 causes color fading, so that food materials displayed in the storage room 12 may appear poorer or the interior of the storage room 12 may become darker.

With the fluorescent lamp 36, it is difficult to effect a performance, such as changing the illumination color according to food materials to be displayed in the storage room 12, in which case the fluorescent lamp 36 should be replaced with a fluorescent lamp 36 of another color. Further, in cleaning the transparent resin cover 40, it is difficult for one's hand to reach the front glass 18 of the cover 40, compelling one to do very troublesome work.

The present invention is proposed to overcome the various inherent problems of the conventional showcase, and it is an object of the invention to provide a showcase which uses an LED illumination device to reduce the running cost and enable effective use of the space in the storage room.

Means for Solving the Problems

To overcome the problems and achieve the object, a showcase according to claim 1 is a showcase in which a storage room to store goods is defined inside an insulated box body having a transparent member fitted into a front opening thereof and a temperature of the storage room is adjusted, wherein an LED illumination device having an LED element mounted on a substrate is provided at the insulated box body to illuminate inside the storage room.

To overcome the problems and achieve the object, a showcase according to claim 16 of the present application is a showcase in which a storage room to store goods is defined inside a box body having a transparent plate fitted into a front opening thereof, wherein an LED illumination device having an LED element mounted on a substrate for illuminating the storage room is provided outside the transparent plate, a shield member which prevents reflected light of the LED illumination device by the transparent plate is adhered to an outer surface of the transparent plate in a vicinity of the LED illumination device by an optically transparent adhesive member, and a scatter surface having a convex concave shape is formed at an adhesion surface of the shield member to the transparent plate to scatter the reflected light which has reached the scatter surface to prevent the reflected light from leaking outside.

EFFECT OF THE INVENTION

The showcase according to the present invention uses an LED illumination device to illuminate the storage room, thus making it possible to reduce the running cost. Further, as the LED illumination device is disposed in at a portion where it does not protrude into the storage room or in free space, the space in the storage room can be used effectively. Furthermore, it is possible to prevent the transparent plate to leak the reflected light of the LED illumination device.

Figure 1:
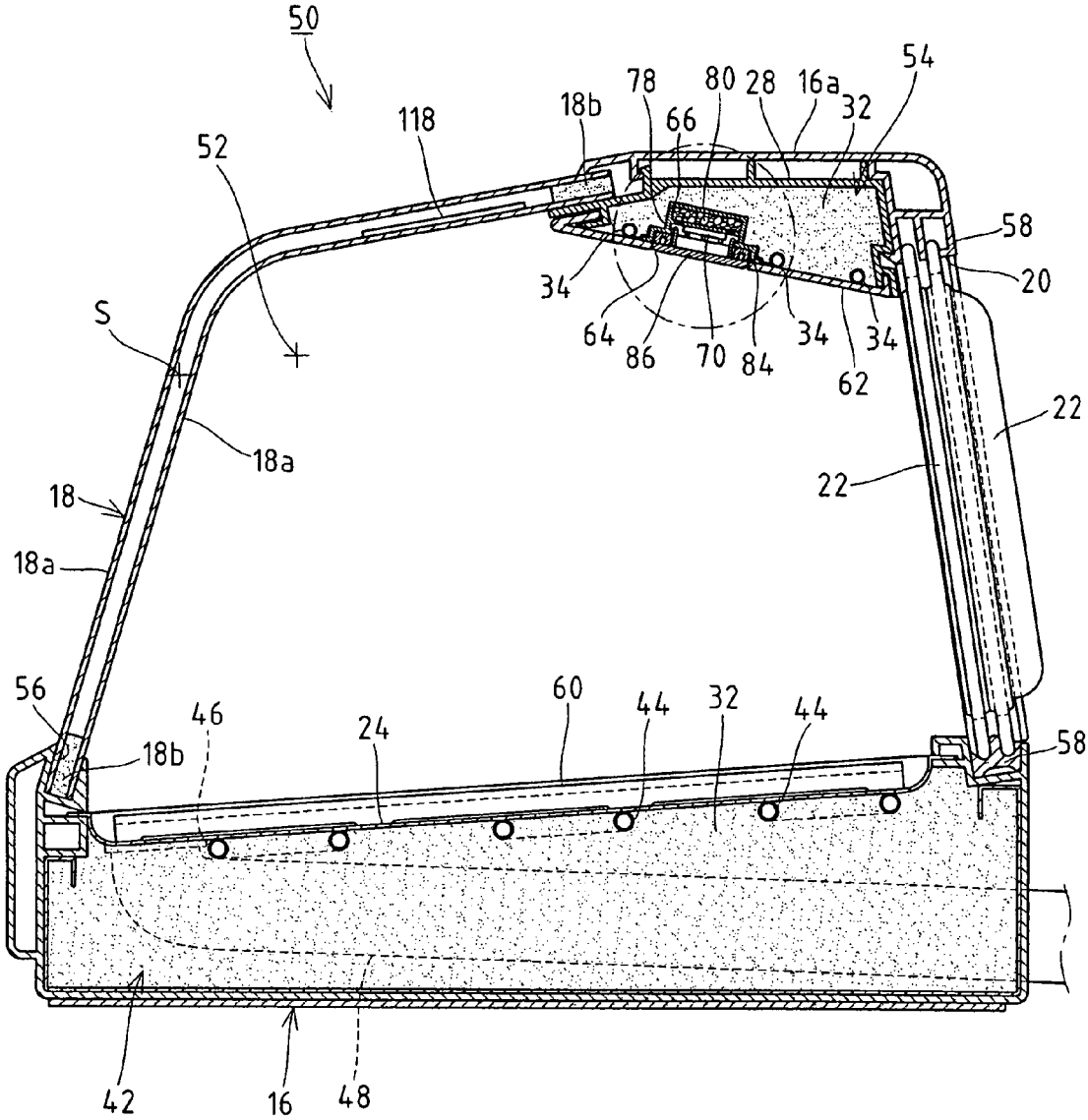
FIG. 1 is a cross-sectional view showing a refrigerated showcase according to a first embodiment.

Best Mode For Carrying Out The Invention

A showcase according to the present invention will be described below by way of preferred embodiments with reference to the accompanying drawings. Like reference numerals are given to those members which have already been explained in the Background Art to omit their detailed descriptions. The descriptions of the embodiments will be given of a case where the showcase is a refrigerated showcase whose storage room is controlled to have a low temperature.

First Embodiment

As shown in FIG. 1, in a refrigerated showcase 50 according to the first embodiment, a storage room 52 which refrigerates goods, such as fresh food materials and beverages, for preservation is defined inside an insulated box body 16 having a heat insulating structure. When the refrigerated showcase 50 is placed on a counter or the like, a front opening 56 is open in the front side of the insulated box body 16 facing customers, a transparent front glass (transparent member) 18 is fitted to the front opening 56, so that goods stored in the storage room 52 can be viewed from the front side. The front glass 18 is a so-called pair glass having a pair of glasses 18*a*, 18*a* arranged facing each other with a predetermined gap therebetween. A spacer 18*b* defines a required space S between both glasses 18*a*, 18*a* in a sealed state. A goods doorway 20 is formed in the rear side of the insulated box body 16. A pair of slide doors 22, 22, which are held at the top and bottom by rails 58, 58, are provided at the goods doorway 20 in such a way as to be slidable rightward and leftward to make the goods doorway 20 openable and closable. The doors that open and close the goods doorway 20 are not limited to the slide doors 22, 22 of the first embodiment, and may be a rotatable door.

A bottom plate 24 which defines the bottom of the storage room 52 is disposed on the top surface of a lower insulating layer (insulating layer) 42 formed at the lower side of the storage room 52 in the insulated box body 16. A lower evaporator 44 is disposed on the lower insulating layer 42 in a zigzag form in such a way as to contact the bottom plate 24 to cool the bottom plate 24, thereby indirectly cooling the storage room 52. The bottom plate 24 is tilted toward the front glass 18 from the goods doorway 20, making goods displayed on a drainboard 60 placed on the bottom plate 24 easier to see from the front side. A drain port 46 is provided at the tilted lower end portion of the bottom plate 24, so that water remaining in the storage room 52 can be discharged out of the refrigerated showcase 50 through a drain pipe 48 connected to the drain port 46 and disposed in the lower insulating layer 42.

The cooling unit that cools the storage room 52 is disposed in a machine room 14 defined inside a cabinet which is integrally provided adjacent to the insulated box body 16, and includes a compressor, a condenser, a fan motor and an expansion valve, etc. (none shown). The cooling unit forms a cycle of causing a vapor coolant compressed by the compressor to be cooled and condensed and liquefied in the condenser positioned downstream by the fan motor, causing the liquefied coolant depressurized by the expansion valve to be transformed into a low-temperature vapor coolant by the upper evaporator 34 and the lower evaporator 44, thereby cooling the storage room 52, and feeding the vapor coolant back to the compressor.

Figure 2:
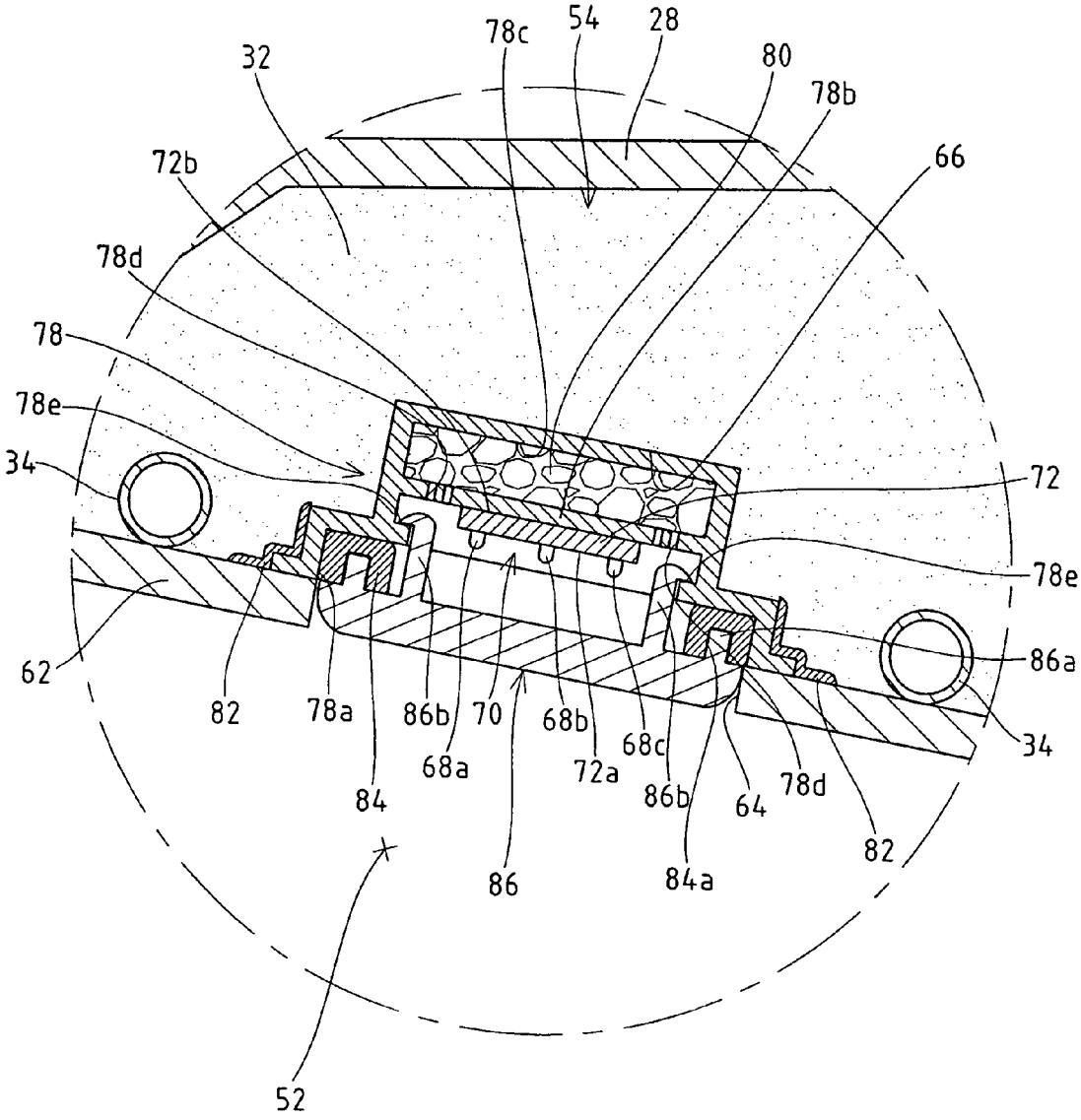
FIG. 2 is an enlarged view showing the essential portion of the refrigerated showcase according to the first embodiment.

An upper insulating layer (insulating layer) 54 formed at the upper portion of the insulated box body 16 has an insulating material 32 filled in the space that is defined by an upper holder 28 supported by a top cover 16*a* of the insulated box body 16 and a cooling plate 62 formed on the top surface of the storage room 52. The upper evaporator 34 connected to the cooling unit is arranged in such a way as to contact the cooling plate 62. As shown in FIG. 2, an opening 64 extending in the widthwise direction of the storage room 52 is formed at that portion of the cooling plate 62 where the upper evaporator 34 does not contact. A receiving space (space) 66 is defined at that portion of the upper insulating layer 54 which faces the opening 64, and an LED illumination device 70 having a plurality of LED elements 68*a*, 68*b*, 68*c* is retained and arranged in the space 66.

Figure 3:
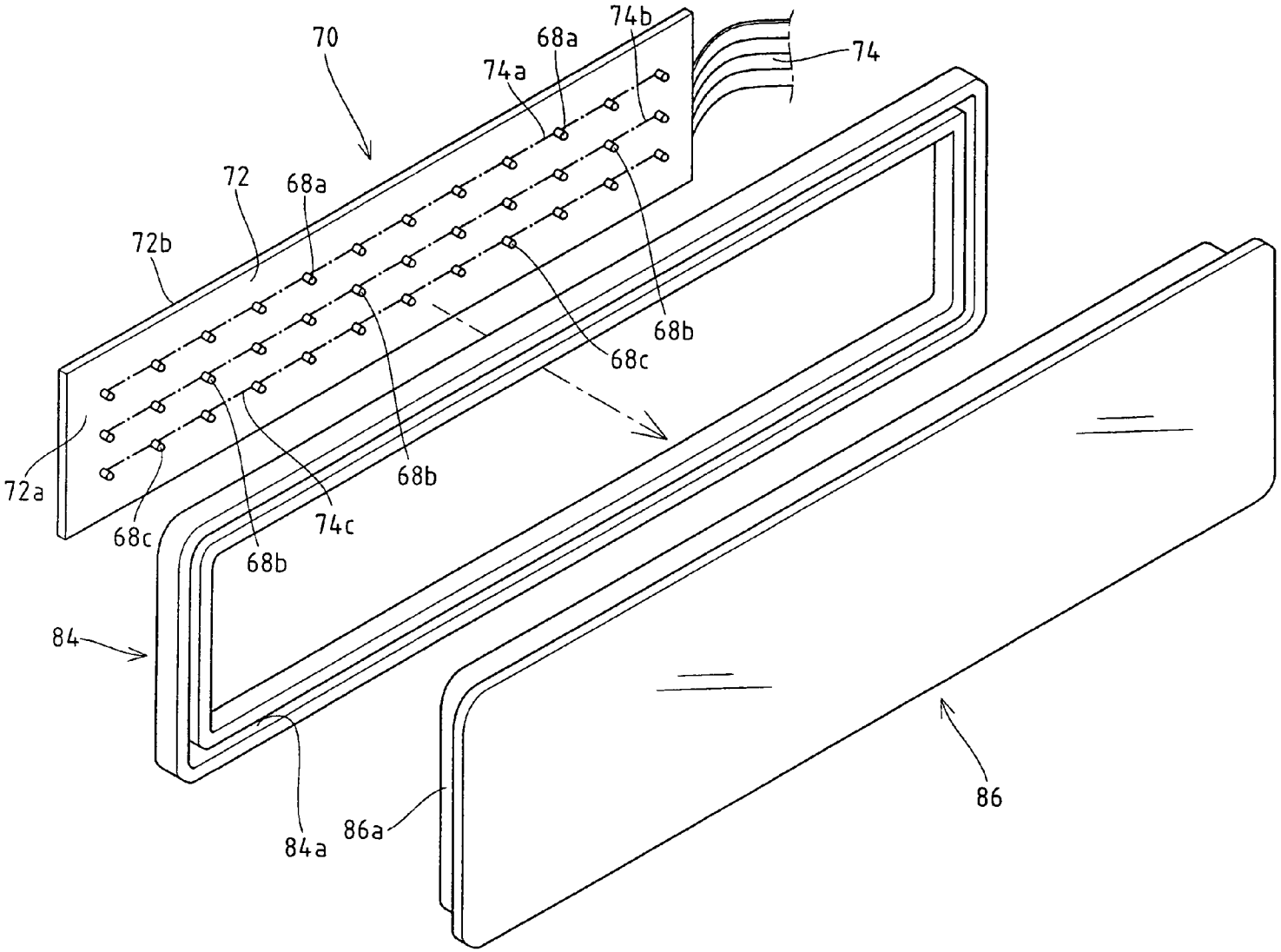
FIG. 3 is a perspective view showing an LED illumination device, packing and cover member.
Figure 4:
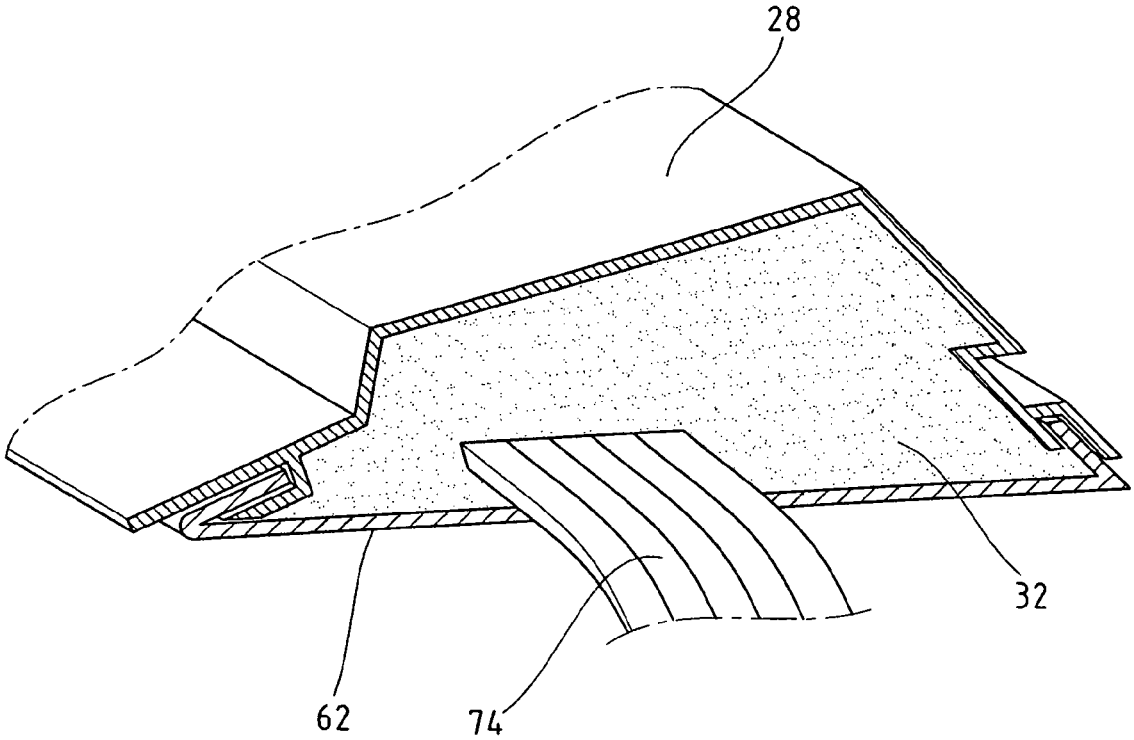
FIG. 4 is a perspective view showing an upper insulating layer according to the first embodiment.

The LED illumination device 70 comprises, as shown in FIGS. 2 and 3. a rectangular substrate 72 extending in the widthwise direction of the storage room 52 by a required length, and a plurality of LED elements (light emitting diodes) 68*a*, 68*b*, 68*c* laid out on one side (surface 72*a*) of the substrate 72. In the embodiment, for example, the red LED elements 68*a* are disposed front side of the substrate 72 in the widthwise direction thereof apart from one another by a predetermined distance, and likewise LED elements 68*b*, 68*c* corresponding to blue and green are respectively disposed in the center and a rear portion of the substrate 72. The individual LED elements 68*a*, 68*b*, 68*c* are connected by respective lead wires 74*a*, 74*b*, 74*c* which are bundled together to extend sideways from the substrate 72. As shown in FIG. 4, the bundled lead wires 74 are led from inside the upper insulating layer 54 to the machine room 14 adjacent to the storage room 52, and are respectively connected to the terminals of operational buttons (to be described later) 76*a*, 76*b*, 76*c* shown in FIG. 5. The LED elements 68*a*, 68*b*, 68*c* which are used as the LED illumination device in the present invention have lower power consumption and higher shock resistance than the conventional fluorescent lamp 36. Further, the LED elements 68*a*, 68*b*, 68*c* have a much longer service life and less discoloration due to degradation over time than the fluorescent lamp or the like. Furthermore, the LED elements 68*a*, 68*b*, 68*c* have a characteristic such that they do not irradiate infrared rays and thus do not lead to a rise in the external temperature.

As shown in FIG. 2, the LED illumination device 70 is attached to the interior of a holder 78 disposed in the receiving space 66. The holder 78 is a resin, such as plastics, formed to have approximately a convex cross-sectional shape and is provided with an opening 78*a* which is open downward. The opening 78*a* is set to have a size approximately matching with the size of the opening 64 of the cooling plate 62. The holder 78 is disposed in the receiving space 66 with the opening 78*a* associated with the opening 64. The internal space of the holder 78 is separated into upper and lower spaces by a mount portion 78*b*. Adhering a back side 72*b* of the substrate 72 to the opening 78*a* side surface of the mount portion 78*b* causes the LED illumination device 70 to be secured to the interior of the holder 78. While a double-coated tape is preferably used to adhere the substrate 72 to the mount portion 78*b*, other means, such as a screw or hook, may be used for fixation.

A retaining portion 78*c* is defined on the top side (opposite side to the opening 78*a*) of the mount portion 78*b* of the holder 78, and a desiccant 80 is retained in the retaining portion 78*c* to dehumidify the interior of the holder 78. A plurality of through holes 78*d* are formed in the mount portion 78*b*, and the atmosphere in the holder 78 is circulated via the through holes 78*d* between the retaining portion 78*c* and the space where the LED illumination device 70 is retained. The entire peripheral edge of the holder 78 is sealed by a seal member 82, to prevent the insulating material 32 from entering the holder 78.

The opening 64 formed in the cooling plate 62 is closed by a cover member 86 via a packing 84 made of rubber or the like. The cover member 86 is formed of a transparent resin to permit transmission of lights irradiated from the LED elements 68*a*, 68*b*, 68*c*, and its outer shape approximately matches the inner shape of the opening 64 of the cooling plate 62. A projection 86*a* is formed on the bottom side (upper surface) of the cover member 86 to be fitted in a groove portion 84*a* formed in the packing 84. As shown in FIG. 2, a pair of engagement portions 86*b*, 86*b* are provided at the bottom side of the cover member 86. As the engagement portions 86*b*, 86*b* are engaged with step portions 78*e*, 78*e* formed on the interior of the holder 78, the cover member 86 is attached to the opening 64. That is, the interior of the holder 78 to which the LED illumination device 70 is attached is sealed by the packing 84 and the cover member 86, preventing water from entering the storage room 52 from outside, and the internal atmosphere of the holder 78 is kept to a low humidity by the desiccant 80.

Figure 5:
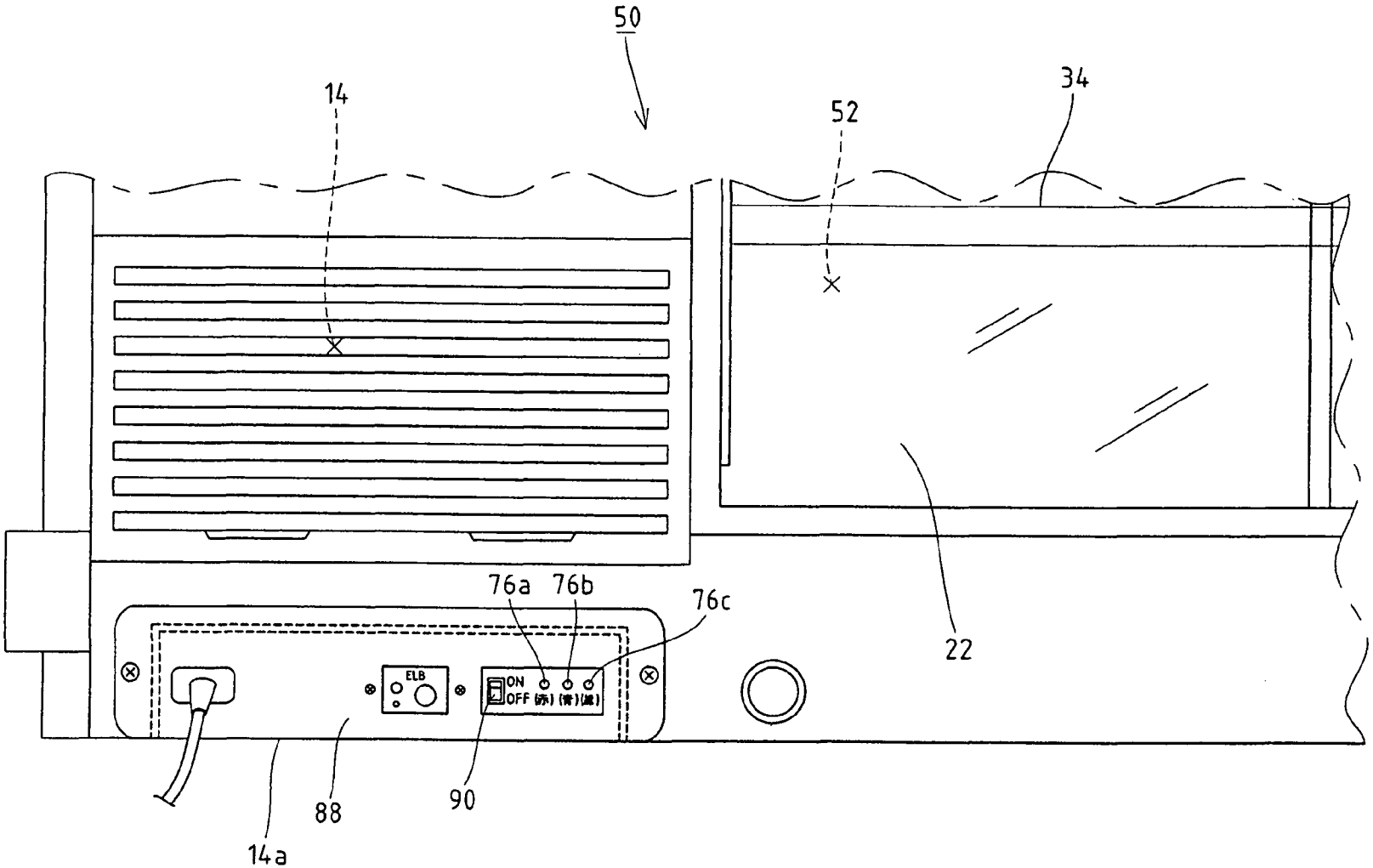
FIG. 5 is an enlarged view showing a part of the rear portion of the refrigerated showcase.

As shown in FIG. 5, an operational panel 88 for various kinds of operations of the refrigerated showcase 50 is disposed at a rear surface portion 14*a* of the machine room 14. As the individual operational buttons 76*a*, 76*b*, 76*c* of "red", "blue" and "green" provided on the panel 88 are operated, the ON/OFF actions of the LED elements 68*a*, 68*b*, 68*c* corresponding to the respective colors can be switched. That is, the LED illumination device 70 is configured in such a way as to be able to change the illumination color according to goods to be displayed in the storage room 52. Lights of all the colors of "red", "blue" and "green" can of course be emitted. Reference numeral "90" denotes the power switch of the LED illumination device 70.

As shown in FIG. 1, a reflection plate 118 which reflects light from the LED illumination device 70 to make the interior of the storage room 52 brighter is provided in the space S of the front glass 18. The reflection plate 118 is a thin plate formed of, for example, stainless, and is adhered to the space S side surface of the glass 18*a* in the storage room 52 by a double-coated tape or the like. The location of the reflection plate 118 can be any location in the front glass 18 where the light from the LED illumination device 70 can be reflected. Instead of the reflection plate 118, a reflection film may be adhered to the inner glass 18*a*. Further, a dye of silver or the like may be printed on the inner glass 18*a* to form a reflection surface.

Operation Of First Embodiment

Next, the operation of the refrigerated showcase 50 according to the first embodiment will be described. At the time the LED illumination device 70 is activated, the power switch 90 provided at the rear surface portion 14*a* of the machine room 14 is set ON. To set all the colors of the LED illumination device 70 on, for example, all the LED elements 68*a*, 68*b*, 68*c* on the substrate 72 are turned on by pressing all of the operational buttons 76*a*, 76*b*, 76*c*. Because the cover member 86 is made of a transparent resin here, the light from the LED illumination device 70 can illuminate the storage room 52 without becoming weaker.

With the reflection plate 118 adhered to the inner glass 18*a* of the front glass 18, the light from the LED illumination device 70 does not directly enter the eyes of a customer. Further, the light from the LED illumination device 70 is reflected by the reflection plate 118, thereby making the interior of the storage room 52 brighter. Furthermore, the inside the space S of the front glass 18 is sealed by the spacer 18*b*, so that dust, stain or the like does not adhere to the reflection plate 118 in the space S. This makes it unnecessary to clean the reflection plate 118. No need of cleaning the reflection plate 118 eliminates the need to secure the rigidity of the reflection plate 118. This can achieve reduction in resources and cost, as well as enlarge the selectable range of materials that can be used for the reflection plate 118. Moreover, as the reflection plate 118 is provided in the space S and is not exposed to the storage room 52, the volume of the storage room 52 does not become smaller, making it easier to clean the storage room 52.

To change the illumination color according to food materials or the like to be displayed, only the operational button 76*a*, 76*b*, 76*c* on the operational panel 88, which corresponds to the LED element 68*a*, 68*b*, 68*c* to be turned on, should be pressed. That is, to turn on only the "red" LED element 68*a*, for example, only the operational button 76*a* corresponding to the element 68*a* should be pressed and the other operational buttons 76*b*, 76*c* should be set OFF. The refrigerated showcase 50 according to the first embodiment can therefore easily change the illumination color according to food materials or the like to be displayed.

Because the LED illumination device 70 is disposed in the upper insulating layer 54 outside the storage room 52, the space in the storage room 52 can be used effectively, allowing large food materials or the like to be displayed and stored. Further, as the LED illumination device 70, unlike the conventional fluorescent lamp 36, does not protrude into the storage room 52, the interior of the storage room 52 can be cleaned easily. As the interior of the holder 78 to which the LED illumination device 70 is attached is sealed, water does not enter from outside, thereby preventing the LED illumination device 70 from failing or being short-circuited. Further, retaining the desiccant 80 in the retaining portion 78*c* of the holder 78 can keep the internal atmosphere of the holder 78 at a low humidity.

Because the LED elements 68*a*, 68*b*, 68*c*, unlike the fluorescent lamp 36 conventionally used, do not generate heat, making it possible to reduce the volume of the cooling unit and suppressing the running cost. As the LED elements 68*a*, 68*b*, 68*c* have a much longer service life and hardly have degradation over time as compared with the fluorescent lamp or the like. It is therefore less likely to cause discoloration or lower the illuminance. This eliminates the need for a troublesome replacement work needed for the conventional fluorescent lamp 36. Since the lead wires 74 of the LED illumination device 70 are laid out in the upper insulating layer 54 and led to the machine room 14 and are not exposed to the interior of the storage room 52, the lead wires 74 do not become a hindrance.

Second Embodiment

Figure 6:
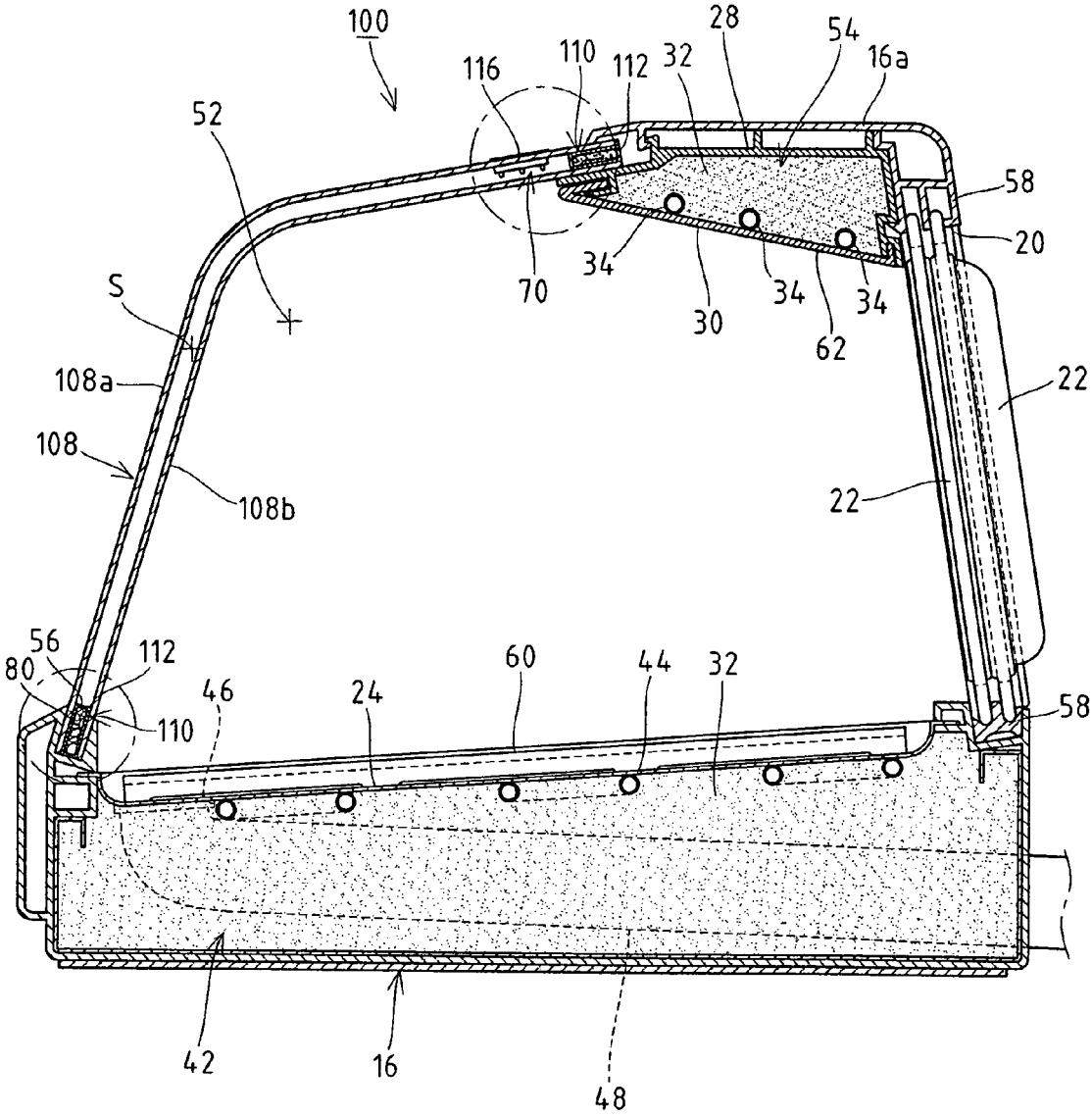
FIG. 6 is a cross-sectional view showing a refrigerated showcase according to a second embodiment.
Figure 7:
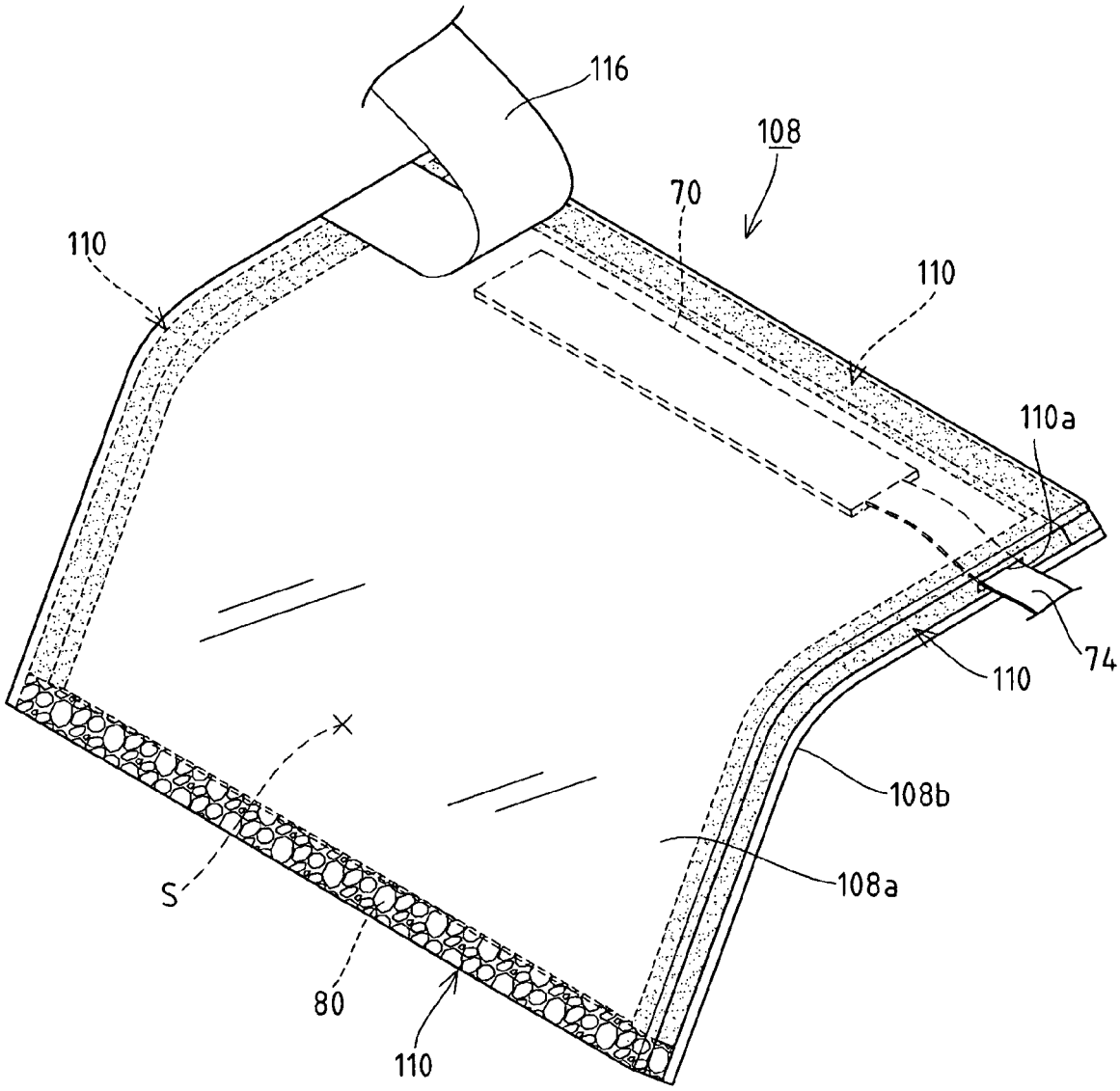
FIG. 7 is a perspective view showing a front glass according to the second embodiment.

A refrigerated showcase according to the second embodiment will be described next. Only the differences of the second embodiment from the first embodiment will be described, and like reference numerals are given to like members to omit their descriptions. FIG. 6 is a cross-sectional view showing a refrigerated showcase 100 according to the second embodiment. As shown in FIG. 7, a front glass 108 fitted in the front opening 56 of the insulated box body 16 is constituted by a pair glass having a pair of glasses 108*a*, 108*b* arranged facing each other with a predetermined gap therebetween and the space S defined between both glasses 180*a*, 108*b*. In the refrigerated showcase 100 of the second embodiment, the LED illumination device 70 is retained in the space.

Figure 8:
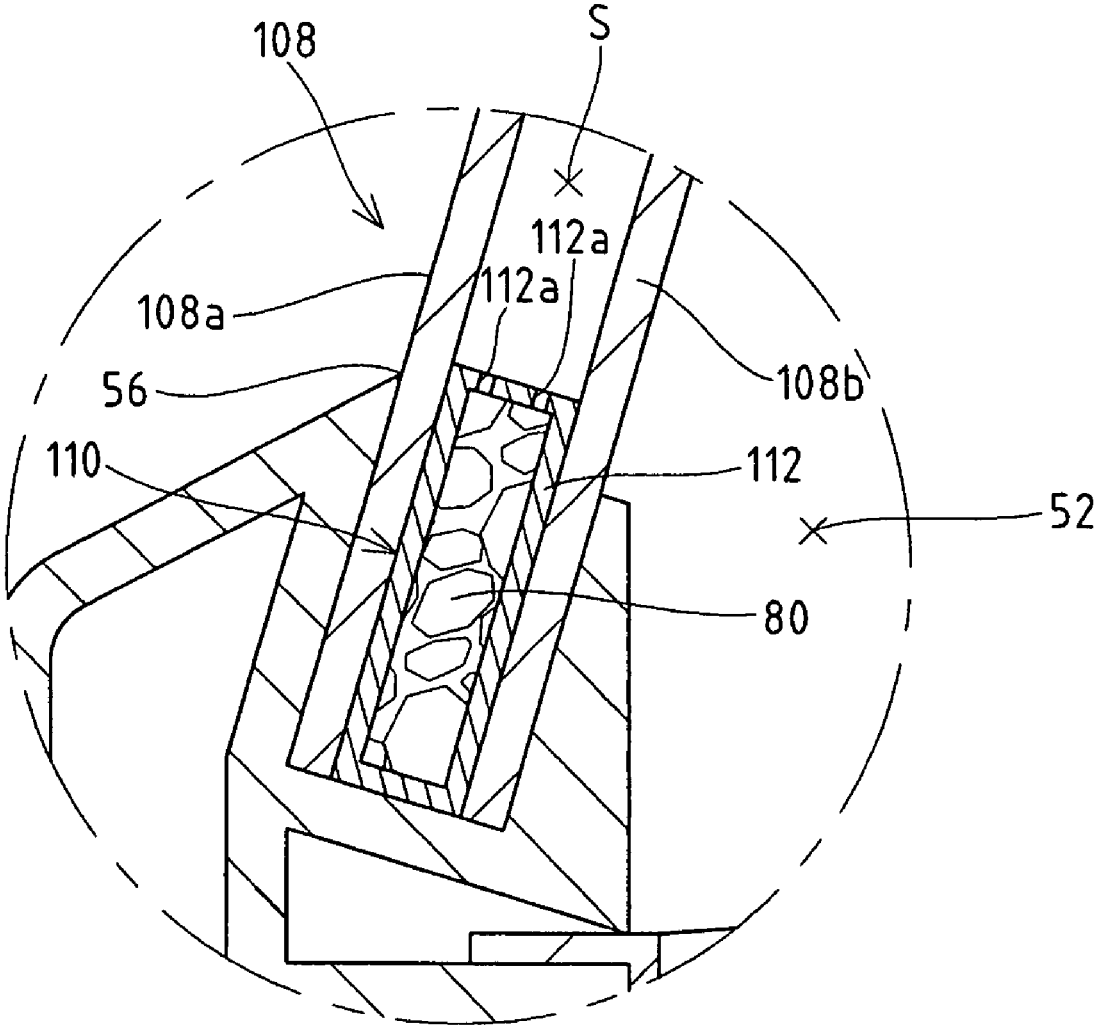
FIG. 8 is an enlarged view showing a case member according to the second embodiment.

The front glass 108 includes an outer glass 108*a* and an inner glass 108*b*, which are formed in rectangular shapes and curved as shown in FIG. 7. A plurality of spacers 110, which secure a gap between both glasses 108*a*, 108*b* and seal the atmosphere in the space S with respect to storage room 52, are provided around the entire edge portions between both glasses 108*a*, 108*b*. That is, the spacer 110 has a case member 112 made of a metal like aluminum provided at the respect edge portion between both glasses 108*a*, 108*b* with an insulating material, such as urethane foam, filled in each case member 112 (see FIGS. 8 and 9). As shown in FIG. 8, through holes 112*a* are formed in the lower case member 112, and the desiccant 80 is retained in the case member 112. Further, the entire edge portions of the front glass 108 are sealed with a caulking like silicon to keep the space S between the glasses 108*a*, 108*b* in a sealed state. That is, the space S defined between both glasses 108*a*, 108*b* is kept sealed, and the internal atmosphere is kept at a low humidity by the desiccant 80.

Figure 9:
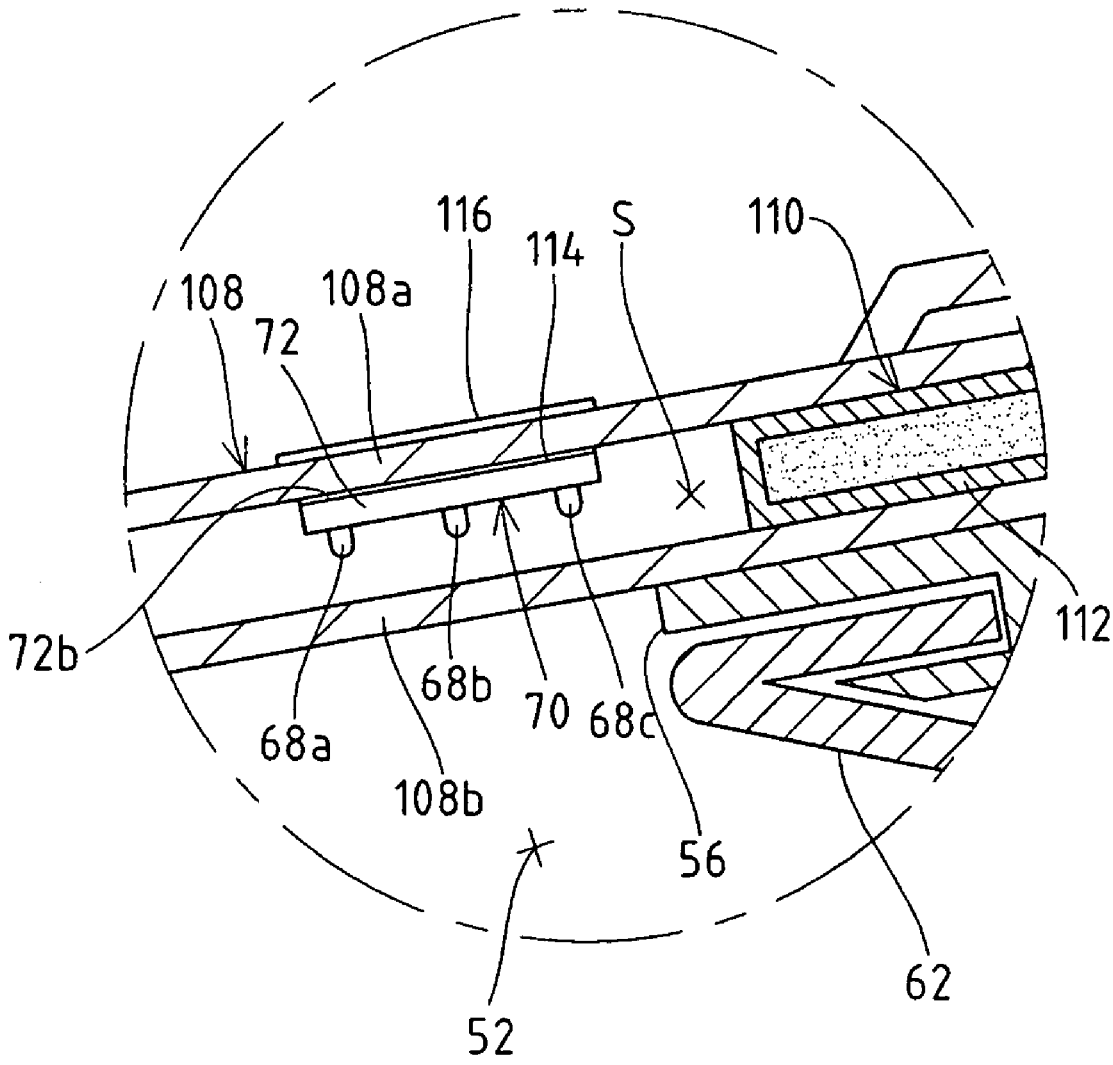
FIG. 9 is an enlarged view showing an LED illumination device according to the second embodiment.

As shown in FIG. 9, the LED illumination device 70 disposed in the space S between both glasses 108*a*, 108*b* is secured by adhering the back side 72*b* of the substrate 72 to the inner surface (space S side) of the outer glass 108*a* with a double-coated tape 114. The LED illumination device 70 is located in the upper portion of the front glass 108. As shown in FIG. 7, lead lines 74 lead out from the side of the substrate 72 of the LED illumination device 70 are led to a machine room 14 via through holes 110*a* formed in the space 110 provided at one side edge of the front glass 108. A black film 116 which covers the substrate 72 and the double-coated tape 114 of the LED illumination device 70 is adhered to the outer surface of the outer glass 108*a* in such a way that the substrate 72 of the LED illumination device 70 and the double-coated tape 114 are not seen from the front (customer side) of the refrigerated showcase 100. It is to be noted that in place of the black film 116, a black silk printing may be applied to the outer glass 108*a*. The black film 116 may be arranged between both glasses 108*a*, 108*b*, i.e., between the outer glass 108*a* and the substrate 72. Arranging the black film 116 in the space S between both glasses 108*a*, 108*b* prevents the black film 116 from being separated at the time of cleaning the surface of the front glass 108.

Operation Of Second Embodiment

Next, the operation of the second embodiment will be described. At the time the LED illumination device 70 is activated, the power switch 90 provided at the rear surface portion 14*a* of the machine room 14 is set ON. To set all the colors of the LED illumination device 70 on, for example, all the LED elements 68*a*, 68*b*, 68*c* on the substrate 72 can be turned on by pressing all of the operational buttons 76*a*, 76*b*, 76*c*. Because the front glass 108 is transparent, the light from the LED illumination device 70 can illuminate the storage room 52 without becoming weaker. To change the illumination color according to food materials or the like to be displayed, only the operational button 76*a*, 76*b*, 76*c* on the operational panel 88, which corresponds to the LED element 68*a*, 68*b*, 68*c*, respectively, to be turned on, should be pressed as has been explained in the first embodiment.

That is, because the LED illumination device 70 is disposed in the space S of the front glass 108 in the refrigerated showcase 100 according to the second embodiment, the space in the storage room 52 can be used effectively to allow large food materials or the like to be displayed and stored. Further, as the LED illumination device 70, unlike the conventional fluorescent lamp 36, does not protrude into the storage room 52, the interior of the storage room 52 can be cleaned easily. As the interior of the space S of the front glass 108 to which the LED illumination device 70 is attached is sealed, water does not enter from outside, thereby preventing the LED illumination device 70 from failing or being short-circuited. Further, as the desiccant 80 is retained in the case member 112 provided at the lower portion of the front glass 108, the internal atmosphere of the space S can be kept at a low humidity.

Because the LED elements 68*a*, 68*b*, 68*c* are used in place of the conventional fluorescent lamp 36, the same effects as those of the first embodiment, such as suppressing the running cost, are brought about. Since the lead wires 74 of the LED illumination device 70 are directly led to the machine room 14 from the space S of the front glass 108, the lead wires 74 are not exposed to the storage room 52 to cause interference.

Note that the film or print which covers the LED illumination device 70 in the second embodiment has only to have a color which matches with stored goods. The configuration of the spacers 110 which separate both glasses 108*a*, 108*b* of the front glass 108 by a required distance is not limited to that of the second embodiment, and a conventionally known configuration can be employed adequately.

While the LED illumination device 70 of the first and second embodiments comprises the "red", "blue" and "green" LED elements 68*a*, 68*b*, 68*c*, it may use LED elements of other colors. Further, the types of colors are not limited to three, and light of one color, lights of two colors, or lights of four or more colors may be emitted.

Third Embodiment

A refrigerated showcase according to the third embodiment will be described next. Only the differences of the third embodiment from the first and second embodiments will be described, and like reference numerals are given to like members to omit their descriptions.

In the above-described second embodiment, the LED illumination device 70 is directly secured into the space S of the front glass 108 by the double-coated tape 114. However, a refrigerated showcase 140 according to the third embodiment, as shown in FIG. 10, has an LED illumination device 120 disposed in the space S of the front glass 108 via a required holder 122.

Figure 10:
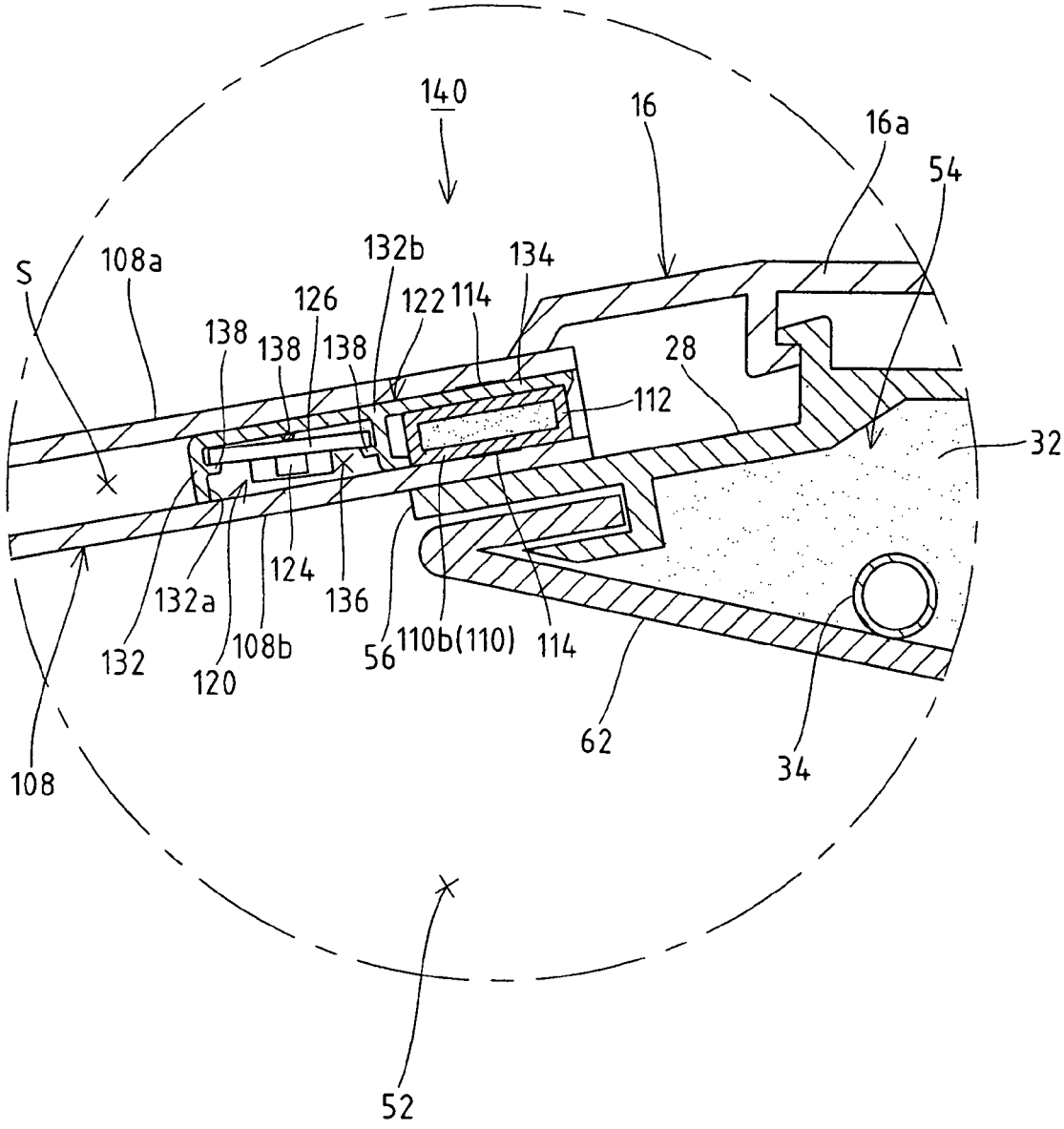
FIG. 10 is an enlarged view showing the essential portion of a refrigerated showcase according to a third embodiment.

As shown in FIG. 10, the holder 122 which receives and holds the LED illumination device 120 comprises a body portion (portion facing frontward and upward) 132 having a channel shape in cross section and an engagement portion 134 which is integrally formed with the body portion 132 and engages with the spacer 110. That is, the holder 122 is disposed in the space S of the front glass 108 in such a way that a portion 110*b* of the spacer 110, which extends in the widthwise direction above the storage room 52, is engaged with the engagement portion 134 in a manner embracing the portion 110*b*.

The body portion 132 has an open portion 132*a* formed in the lengthwise direction, which is open downward or toward the storage room 52, and a receiving space 136 defined and capable of receiving the LED illumination device 120 therein. A plurality of hold portions 138 which hold the LED illumination device 120 in a tilted state by a required angle are formed in the receiving space 136. That is, as shown in FIG. 10, with the LED illumination device 120 held tilted by the hold portions 138, the illumination direction of the LED elements is directed in such a direction as to suitably illuminate the interior of the storage room 52. Further, at the time the LED illumination device 120 is attached to the holder 122, a substrate 126 can be positioned (temporarily fixed) by the hold portions 138. In the third embodiment, as shown in FIG. 10, a plurality of projecting (rib-shaped) portions are formed in the receiving space 136 to be the hold portions 138. However, the hold portions 138 are not limited to this structure, and other structures may be employed as long as they can hold the LED illumination device 120 in a tilted state.

The body portion 132 facing the outer side of the refrigerated showcase 140 is formed of a non-transparent or translucent synthetic resin or the like, so that the light from the LED illumination device 120 is not directly irradiated frontward and upward of the refrigerated showcase 140. Further, the non-transparent or translucent body portion 132 prevents the substrate 126 or the like of the LED illumination device 120 from being seen from outside. The open portion 132*a* of the body portion 132 may be closed by a transparent lid member.

The engagement portion 134 extends toward the spacer 110 at an edge portion 132*b* of the body portion 132 which abuts on the outer glass 108*a*, and is configured in such a way as to engage with the portion 110*b* in a manner embracing the portion 110*b*. That is, as the engagement portion 134 engages with the case member 112 of the spacer 110 which is formed of a metal like aluminum to have a rigidity, the holder 122, even if having an elongated shape, becomes difficult to be warped, thus making it possible to linearly fix the holder 122 along the portion 110*b* of the spacer 110. The surface of the upper side of the engagement portion 134 abuts on the inner surface (surface on the space S side) of the outer glass 108*a*, and the engagement portion 134 is adhered to the outer glass 108*a* by the double-coated tape 114 or the like. The fixation to the holder 122 with the double-coated tape 114 or the like is only for the fixation of the engagement portion 134 and the outer glass 108*a*. The fixation of the portion 110*b* in the spacer 110 is achieved by adhering the surface of the portion 110*b* on the storage room 52 side to the inner surface of the inner glass 108*b* (surface on the space S side) with the double-coated tape 114.

Figure 11:
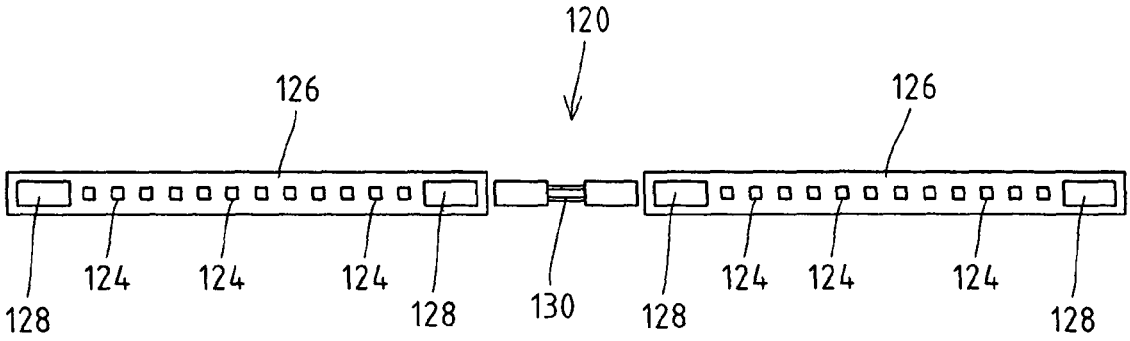
FIG. 11 is a schematic explanatory diagram showing an LED illumination device which is used in the third embodiment.

The LED illumination device 120 which is used in the third embodiment is configured in such a way that a plurality of LED elements 124 of the same color are laid out in a line on a plurality of substrates 126 coupled in series. That is, as shown in FIG. 11, a plurality of units each having a plurality of LED elements 124 laid out in a line on the substrate 126 extending in the widthwise direction by a required length are coupled in series to constitute the LED illumination device 120. The individual units are coupled by connecting connectors 128, 128 provided at both end portions of each substrate 126 via a relay line 130. It is therefore possible to illuminate the interior of the storage room 52 with the desired brightness by changing the number of units coupled according to the width size of the storage room 52. Given that the storage room 52 has a width of 845 mm and one unit includes 12 white LED elements 124 of 0.08 W provided on the substrate 126 having a width of 260 mm, three of the units coupled together can provide a sufficient brightness. Since the LED elements 124 of one color are used in the third embodiment, the operational buttons 76*a*, 76*b*, 76*c* corresponding to the respective colors in the first embodiment and the second embodiment are unnecessary, and the LED illumination device 120 is activated (switched on) merely by setting the power switch 90 ON.

Operation Of Third Embodiment

Next, the operation of the third embodiment will be described. At the time the LED illumination device 120 is disposed in the space S, first, the LED illumination device 120 is received in the receiving space 136 in the holder 122. That is, the substrates 126 are secured to the hold portions 138 and the LED illumination device 120 is held tilted by a required angle in the receiving space 136. Because the LED illumination device 120 is positioned (temporarily fixed) by the hold portions 138 at the time, the work of assembling the LED illumination device 120 can be performed efficiently.

Next, with the engagement portion 134 engaged with the upper-side portion 110*b* of the spacer 110 which extends in the widthwise direction, the holder 122 is disposed along the portion 110*b*. That is, the case member 112 of the spacer 110 has a required rigidity and is linearly fixed to the front glass 108, and as the engagement portion 134 is engaged in such a way as to embrace the case member 112, the holder 122 becomes difficult to be warped and can be arranged straight. This eliminates a need for a step of correcting warping of the holder 122, so that the work of attaching the holder 122 becomes efficient. As the surface of the upper side of the engagement portion 134 is adhered to the surface of the outer glass 108*a* on the space S side surface by the double-coated tape 114, the LED illumination device 120 is provided together with the holder 122 in the space S.

At the time of activating the LED illumination device 120, the power switch 90 provided at the rear surface portion 14*a* of the machine room 14 is set ON. At this time, that portion (open portion 132*a*) of the body portion 132 of the holder 122 which is located on the storage room 52 side is open and the front glass 108 is transparent, so that the light from the LED illumination device 120 can illuminate the storage room 52 without becoming weaker. What is more, because the LED illumination device 120 is received tilted by a required angle in the holder 122 as mentioned above, it can suitably illuminate the storage room 52 wherever needed. As the body portion 132 of the holder 122 is formed of a non-transparent or translucent material, the light from the LED elements 124 is not irradiated directly frontward or upward, so that a customer positioned in front and a sushi chef positioned above do not feel the light glaring. Further, the substrate 126 or the like of the LED illumination device 120 is not seen from outside, which does not impair the good appearance of the refrigerated showcase 140.

As described above, the refrigerated showcase 140 according to the third embodiment is configured to have the holder 122 disposed in the space S with the engagement portion 134 engaged with the spacer 110. However, the holder 122 may be comprised only of the body portion 132 and secured in the space S without being engaged with the spacer 110. If the light from the LED illumination device 120 suitably reaches the storage room 52, the LED illumination device 120 should not necessarily be received tilted in the holder 122 but may be provided in parallel to the front glass 108. Further, the desiccant 80 of the first embodiment may bee retained in the holder 122. Furthermore, the spacers 110 according to the third embodiment are arranged along the entire periphery between both glasses 108*a*, 108*b* and are so configured as to seal the interior of the space S. If the interior of the space S is sealed to make it unnecessary to dehumidify the space S with the desiccant 80, the spacers 110 should not necessarily be provided along the entire periphery between both glasses 108*a*, 108*b*.

First Modification Of Third Embodiment

Figure 16:
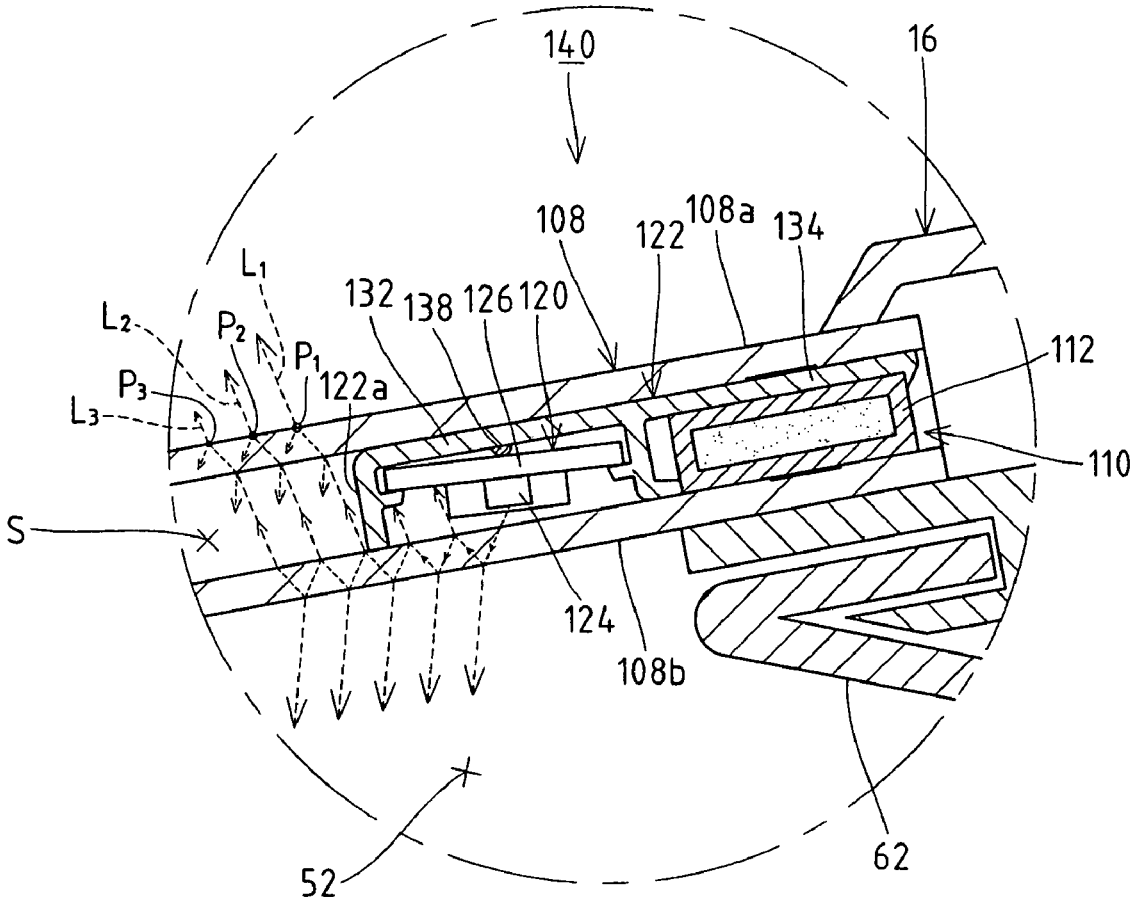
FIG. 16 is an explanatory diagram showing how light from the LED illumination device is reflected and irradiated outside.

There may be a case where when the LED illumination device 120 in the refrigerated showcase 140 according to the above-described third embodiment is activated, the light irradiated from the LED illumination device 120 is reflected at the inner glass 108*b* to leak outside depending on the tilt angle of the substrate 126 and the shape of the inner glass 108*b*. That is, as shown in FIG. 16, as the light from the LED illumination device 120 repeats reflection in the inner glass 108*b*, a plurality of reflected lights transmit the outer glass 108*a* to leak outside. In this case, when the refrigerated showcase 140 is viewed from the front side, a plurality of light spots (light spots $P_1$, $P_2$, $P_3$, . . . ) appear regularly laid out on the outer glass 108*a* in the vicinity of the holder 122, which impairs the appearance of the refrigerated showcase 140. As shown in FIG. 16, of the reflected lights which leak outside, a first reflected light $L_1$ which passes nearest a front end portion 122*a* has a smaller number of reflections and becomes the strongest reflected light. Therefore, the light spot $P_1$ formed by the first reflected light $L_1$ is the brightest to be most noticeable. That is, the intensity of the reflected light leaking outside the front glass 108 becomes smaller as the position of the light becomes farther from the front end portion 122*a* of the holder 122 (farther from the outer periphery of the front glass 108).

In this respect, the refrigerated showcase 140 according to the first modification of the third embodiment is configured in such a way that a thin plate-like shield member 198 is provided at the outer surface of the outer glass 108*a* to shield at least the first reflected light $L_1$ among the lights from the LED illumination device 120 which leak outside. The shield member 198 is a widthwisely-long rectangular thin plate formed of a metal or resin or the like with a low light transmittance, and is adhered to the outer surface of the outer glass 108*a* along the entire width direction by an adhesive. The short-side length l of the shield member 198 is set to a value which can shield the first reflected light $L_1$. That is, when the shield member 198 is adhered to the outer glass 108*a*, a front edge portion 198*a* of the shield member 198 extends frontward (leftward in FIG. 17) by a required length to completely cover the holder 122.

Because the strongest first reflected light $L_1$ among the reflected lights from the LED illumination device 120 is shielded by the shield member 198 of the refrigerated showcase 140 according to the first modification, the appearance of the refrigerated showcase 140 can be improved. When the shield member 198 shields only the first reflected light $L_1$, the area of the shield member 198 can be set to the minimum size required. Therefore, the area of the front glass 108 which is covered with the shield member 198 becomes the minimum size required, so that the mount of light taken into the storage from outside is hardly reduced. While the other reflected lights other than the first reflected light $L_1$ (second reflected light $L_2$, third reflected light $L_3$, . . . ) are not shielded by the shield member 198 and leak outside, such reflected lights repeat reflection more than the first reflected light $L_1$, so that the light spots $P_2$, $P_3$, . . . do not become so noticeable as one views the refrigerated showcase 140 from the front side. If necessary, the length l of the shield member 198 may be increased so as to be able to shield the second reflected light $L_2$ or the third reflected light $L_3$. Although the shield member 198 is formed into a thin plate according to the first modification, the shield member 198 may be formed by an adhesive sheet or the like with a low transmittance.

Second Modification Of Third Embodiment

Figure 18:
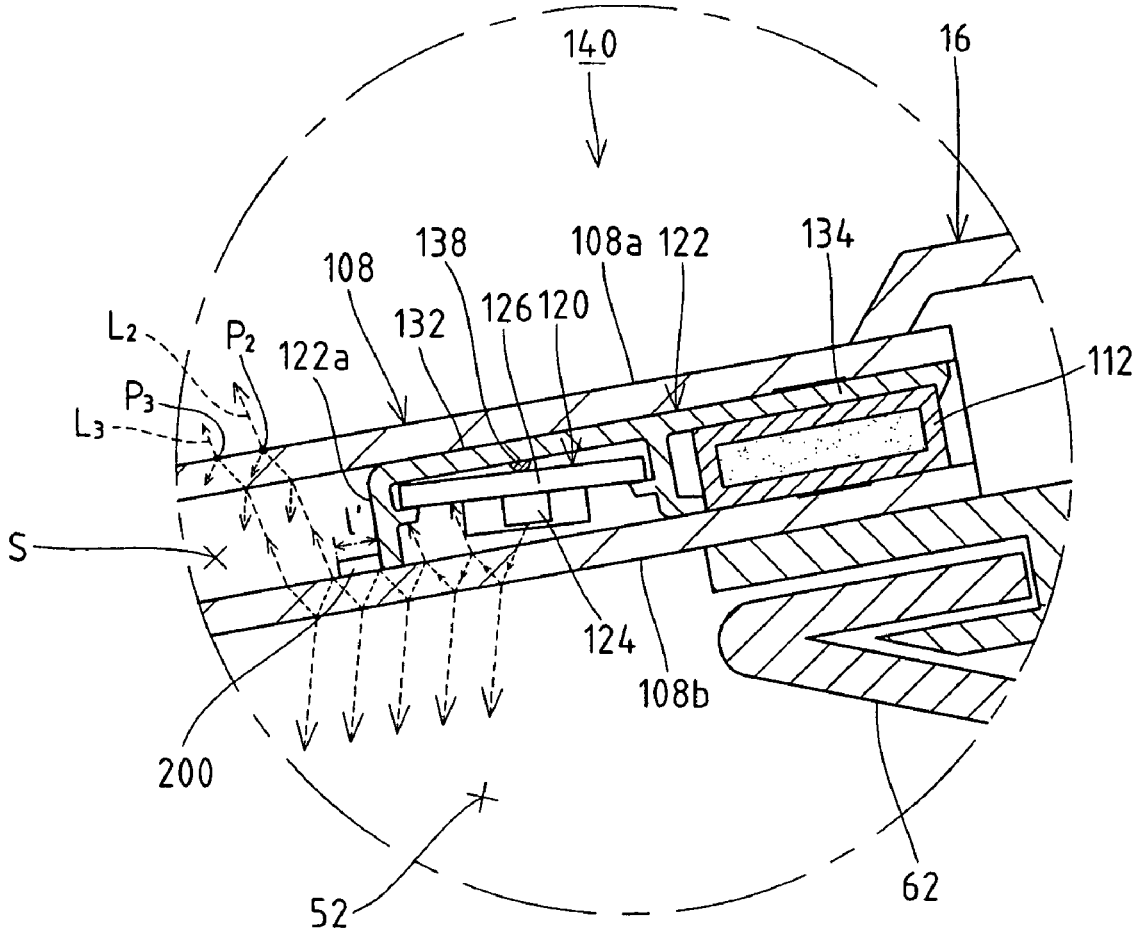
FIG. 18 is an enlarged view showing the essential portion of the refrigerated showcase according to a second modification of the third embodiment.

A refrigerated showcase 140 according to the second modification of the third embodiment will be described next. In the first modification, as described above, the shield member 198 is provided at the outer surface of the outer glass 108*a*. By way of comparison, as shown in FIG. 18, a shield member 200 according to the second modification is provided at that portion of the inner glass 108*b* which is on the space S side and is opposite to the engagement portion 134 of the holder 122. That is, the shield member 200 is provided on the space S side surface of the inner glass 108*b* in such a way as to be close to the front end portion 122*a* of the body portion 132 which is opposite to the spacer 110 in the second modification. The shield member 200, like the shield member 198 of the first modification, is placed to shield the first reflected light $L_1$, and is formed into a thin plate of a metal or synthetic resin or the like with a low transmittance. Because the shield member 200 of the second modification is provided on the space S side surface of the inner glass 108*b*, however, the short-side length l' of the shield member 200 can be made smaller.

Figure 17:
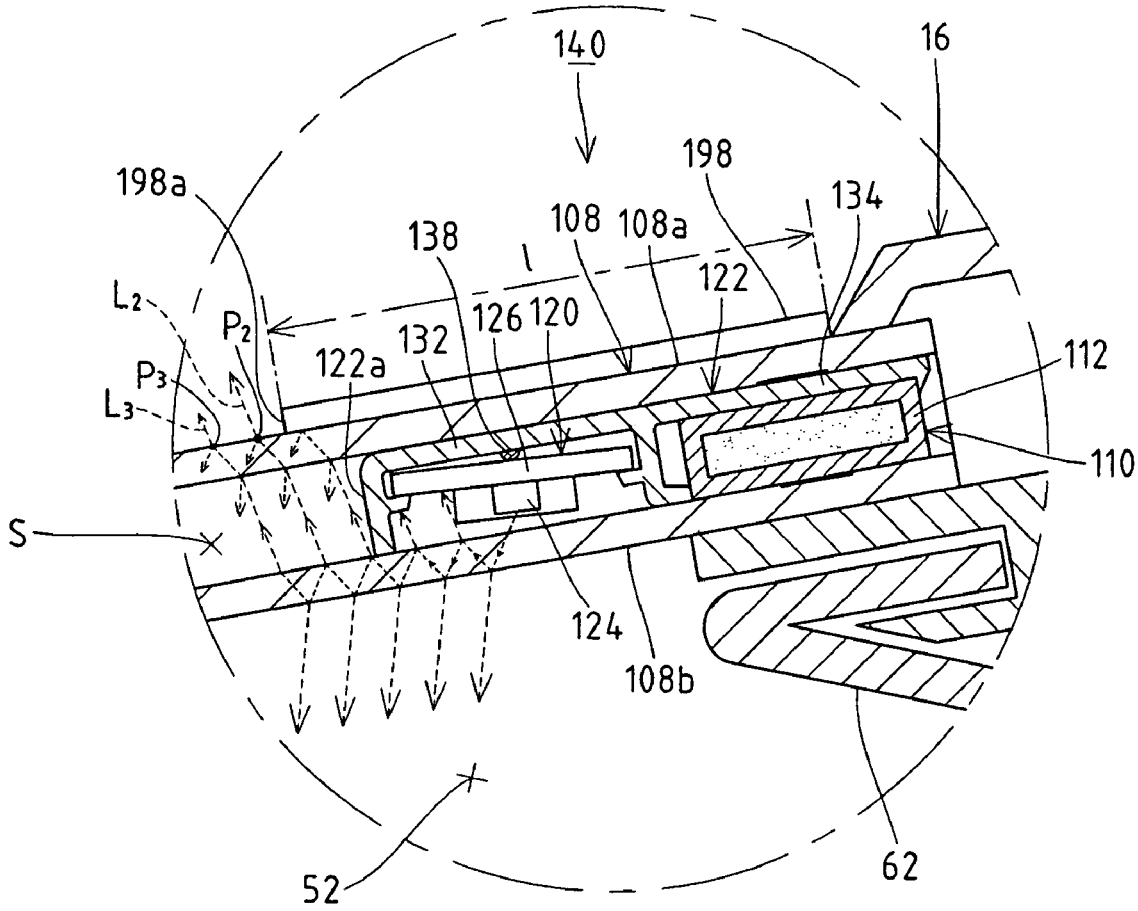
FIG. 17 is an enlarged view showing the essential portion of the refrigerated showcase according to a first modification of the third embodiment.

That is, because the shield member 200 of the second modification is provided on the space S side surface of the inner glass 108*b* in the refrigerated showcase 140 of the second modification, the short-side length l' that is needed to shield the first reflected light $L_1$ can be set smaller than the length l of the first modification shown in FIG. 17. Therefore, the area of the shield member 200 becomes smaller, thus makes it easier for the external light to enter the storage to keep the interior of the storage brighter. The reduction in the area of the shield member 200 reduces the manufacture cost for the shield member 200. The shield member 200 of the second modification may also be modified so as to be able to shield the second reflected light $L_2$, the third reflected light $L_3$, etc. as well as the first reflected light $L_1$.

Figure 19:
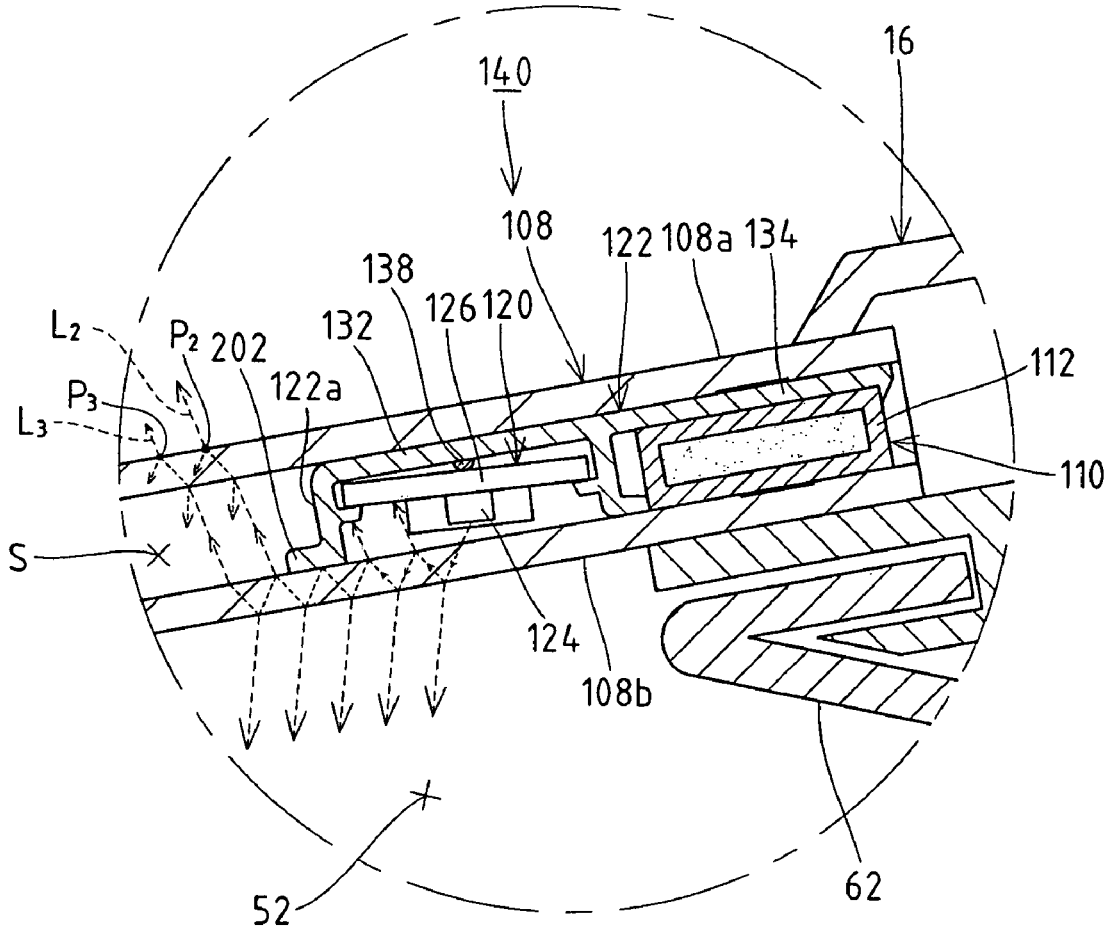
FIG. 19 is an enlarged view showing the essential portion of the refrigerated showcase according to another example of the second modification of the third embodiment.

The configurations of the shield members 198, 200 of the first modification and the second modification are just examples, and other configurations may be employed adequately as long as they can prevent the reflected lights of the LED illumination device 120 from leaking outside. The shield member may therefore be provided at any location where reflected lights can be suitably shielded, such as the inner surface of the outer glass 108*a* or any place of the front glass 108. That is, because the reflection direction of light (the position of appearance of light spot $P_1$, $P_2$, $P_3$, . . . ) is varied according to examples of the refrigerated showcase 140, the shield member should be provided at the proper location of the front glass 108 so as to be able to shield at least the first reflected light $L_1$. As the shield member, a coating material with a low transmittance may be sprayed at the adequate locations of the outer glass 108*a* or the inner glass 108*b*. Further, as shown in FIG. 19, a shield member 202 may be formed integrally at the lower end of the front end portion 122*a* of the holder 122.

Fourth Embodiment

A refrigerated showcase according to the fourth embodiment will be described next. Only the differences of the fourth embodiment from the first to third embodiments will be described.

Figure 12:
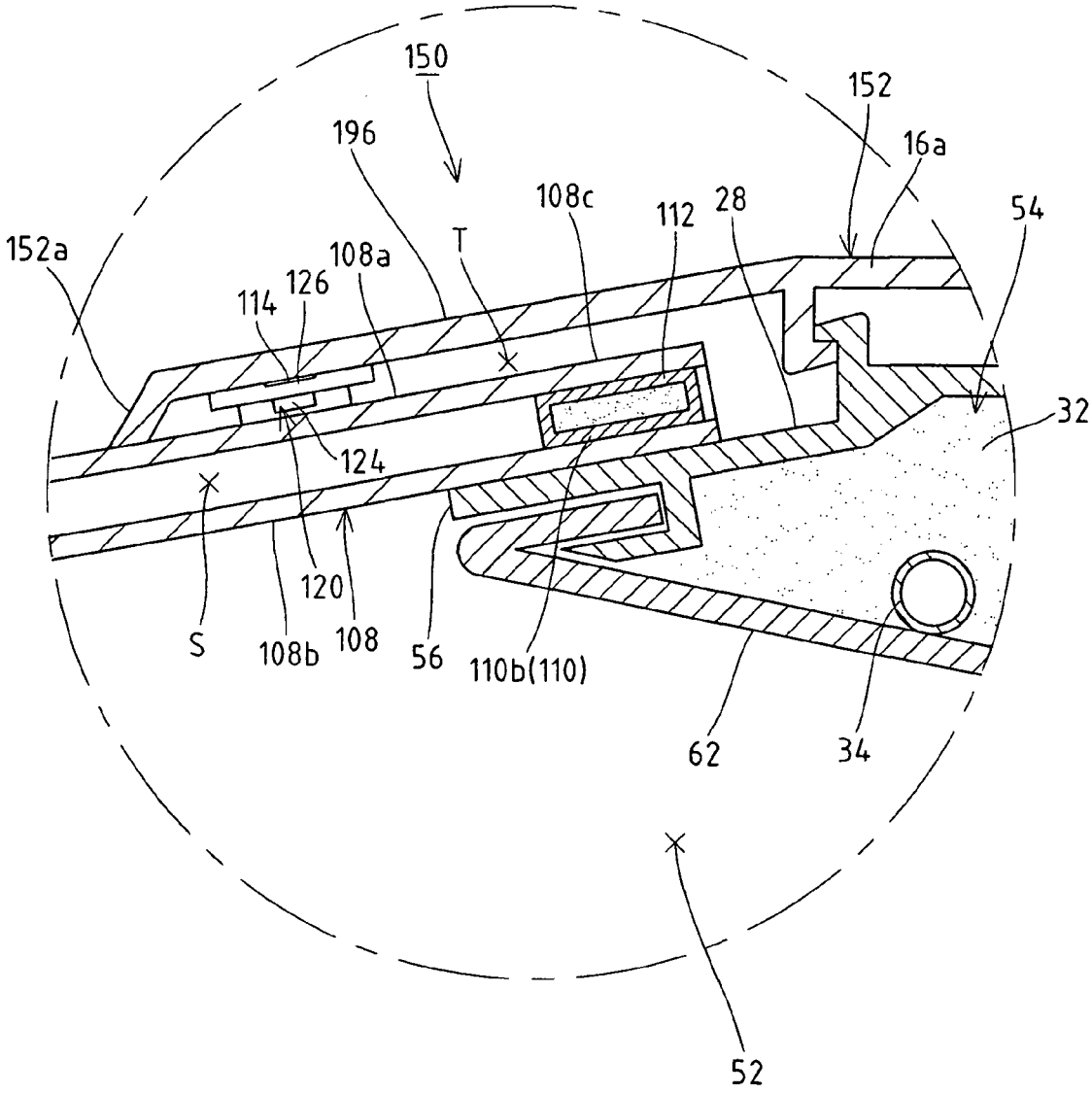
FIG. 12 is an enlarged view showing the essential portion of a refrigerated showcase according to a fourth embodiment.

FIG. 12 is a diagram showing, in enlargement, the essential portion of a refrigerated showcase 150 according to the fourth embodiment. The refrigerated showcase 150 has a top cover 152 formed of a non-transparent material disposed at the upper portion of the insulated box body 16, a required space T defined between the top cover 152 and the front glass 108, and the LED illumination device 120 directly disposed in the space T. That is, a holder 196 extending so as to overlie an edge portion 108*c* of the front glass 108 which lies above the storage room 52 is provided at the front end of the top cover 152, thereby defining the space T between the holder 196 and the front glass 108. As the substrate 126 of the LED illumination device 120 is adhered to the surface of the holder 196 on the space T side by the double-coated tape 114 or the like, the LED illumination device 120 is attached into the space T. As shown in FIG. 12, a front edge portion 152*a* of the holder 196 is tilted downward (toward the storage room 52) and is sealed in abutment on the front glass 108, and the space T is kept sealed. The desiccant 80 of the first embodiment may be retained in the holder 196. The location of the LED illumination device 120 in the space T is set to the position where the interior of the storage room 52 is suitably illuminated.

That is, as the LED illumination device 120 is retained in the space T outside the storage room 52 in the refrigerated showcase 150 according to the fourth embodiment, the space in the storage room 52 can be used effectively without becoming narrower. The sealing of the space T prevents the lights from the LED illumination device 120 from leaking outside (frontward and upward of the refrigerated showcase 150). Further, as the substrate 126 or the like of the LED illumination device 120 is not seen from outside, the good appearance of the refrigerated showcase 150 will not be impaired. Furthermore, the provision of the LED illumination device 120 at the bottom surface of the holder 196 of the top cover 152 can protect the LED illumination device 122 from physical/mechanical shocks.

Although the LED illumination device 120 is disposed directly in the space T in the fourth embodiment, it may be placed via the holder or the like of the above-described embodiments. That is, for example, the LED illumination device 120 can be held by something like the body portion 132 of the holder 122 of the third embodiment. Although the foregoing description of the fourth embodiment has been given of the case where the front edge portion 152*a* of the holder 196 is sealed onto the front glass 108 to seal the interior of the space T, the interior of the space T should not necessarily be sealed.

Fifth Embodiment

A refrigerated showcase according to the fifth embodiment will be described next. Only the differences of the fifth embodiment from the first to fourth embodiments will be described.

Figure 13:
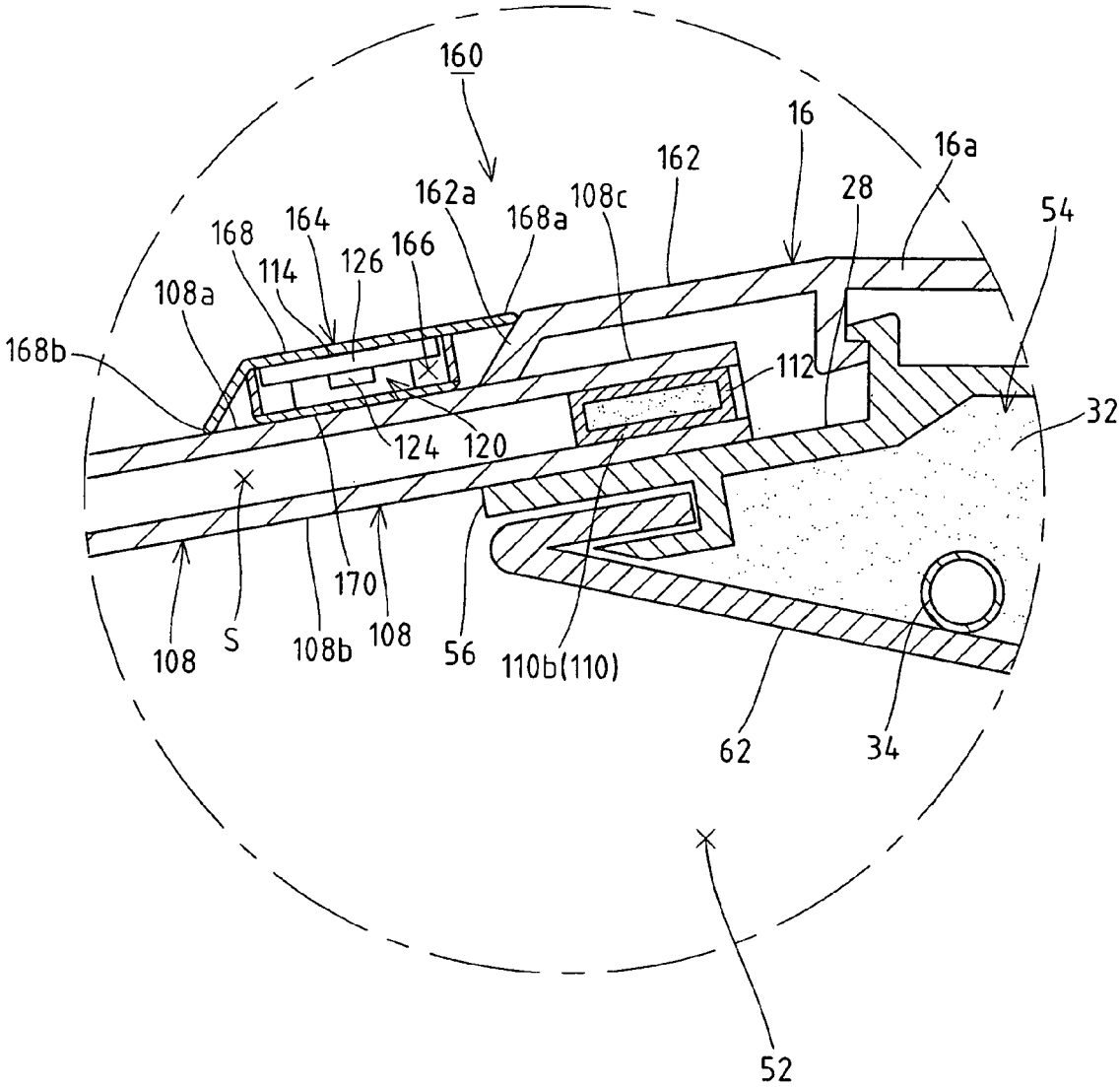
FIG. 13 is an enlarged view showing the essential portion of a refrigerated showcase according to a fifth embodiment.

A refrigerated showcase 160 according to the fifth embodiment, as shown in FIG. 13, has a holder 164 provided at that portion of the front glass 108 which is near a top cover 162 provided at the upper portion of the insulated box body 16, and the LED illumination device 120 disposed in the holder 164. The top cover 162 is provided at the upper portion of the insulated box body 16 in such a way that its front side covers the edge portion 108*c* at the upper side of the front glass 108. The holder 164 is laid along the widthwise direction of the front glass 108 while in abutment on a front edge portion 162*a* of the top cover 162 which faces the front glass 108.

The holder 164 has a receiving space 166 defined inside to receive the LED illumination device 120, and an outer surface portion 168 which faces outward (portion facing frontward and upward) is formed of the same type of non-transparent material as that of the top cover 162. A rear edge portion 168*a* of the outer surface portion 168 abuts on the front edge portion 162*a* of the top cover 162, while a front edge portion 168*b* of the outer surface portion 168 abuts on the outer surface of the outer glass 108*a* of the front glass 108. That is, the portion of the holder 164 which faces frontward and upward is formed of the same type of non-transparent material as that of the top cover 162, and the holder 164 is provided contiguous to the top cover 162, so that one does not feel awkward. The outer surface portion 168 may be formed by a translucent member to slightly leak the lights from the LED illumination device 120 outside.

A transparent lid member (portion facing the transparent member 108) 170 which seals the receiving space 166 is provided at the side of the holder 164 which faces the front glass 108 to prevent dust and water from entering the receiving space 166. The substrate 126 of the LED illumination device 120 is adhered to the bottom surface (surface on the receiving space 166 side) of the outer surface portion 168 by the double-coated tape 114 or the like, thereby securing the LED illumination device 120 into the receiving space 166. The lights from the LED illumination device 120 are irradiated to the storage room 52 via the lid member 170 and the front glass 108. The desiccant 80 of the above-described first embodiment may be retained in the holder 164.

That is, as the refrigerated showcase 160 according to the fifth embodiment has the LED illumination device 120 received in the holder 164 provided along the top cover 162, the space in the storage room 52 can be used effectively without becoming narrower. Because the outer surface portion 168 of the holder 164 is formed of the same type of material as that of the top cover 162, one does not feel awkward about the holder 164 and the good appearance of the refrigerated showcase 160 will not be impaired. Further, as the outer surface portion 168 is formed by a non-transparent member, the lights from the LED illumination device 120 do not leak outside and the substrate 126 or the like of the LED illumination device 120 is not seen from outside. In addition, as the receiving space 166 where the LED illumination device 120 is received is sealed tightly by the lid member 170, it is possible to prevent dust and water from entering to cause failure of the LED illumination device 120. Furthermore, the reception of the LED illumination device 120 in the holder 164 can protect the LED illumination device 120 from physical/mechanical shocks.

The above-described refrigerated showcases 100, 140, 150, 160 according to the second to fifth embodiments, like the one of the first embodiment, have the evaporator 34 provided at the upper insulating layer 54 to cool the storage room 52 via the cooling plate 62. However, the showcase may be of the type in which the upper insulating layer 54 and the cooling plate 62 are not provided and a large evaporator is exposed to the storage room 52 to directly cool the storage room 52. Other types of refrigerated showcases may be possible, such as a cool-air circulation type which circulates cool air cooled by the evaporator 34 to the storage room 52 to cool the storage room 52, or a type which has a cool-air circulation passage provided outside the storage room 52 and circulates cool air in the passage to cool the storage room 52 in a high humidity state.

Sixth Embodiment

A refrigerated showcase according to the sixth embodiment will be described next. Only the differences of the sixth embodiment from the first to fifth embodiments will be described.

Figure 14:
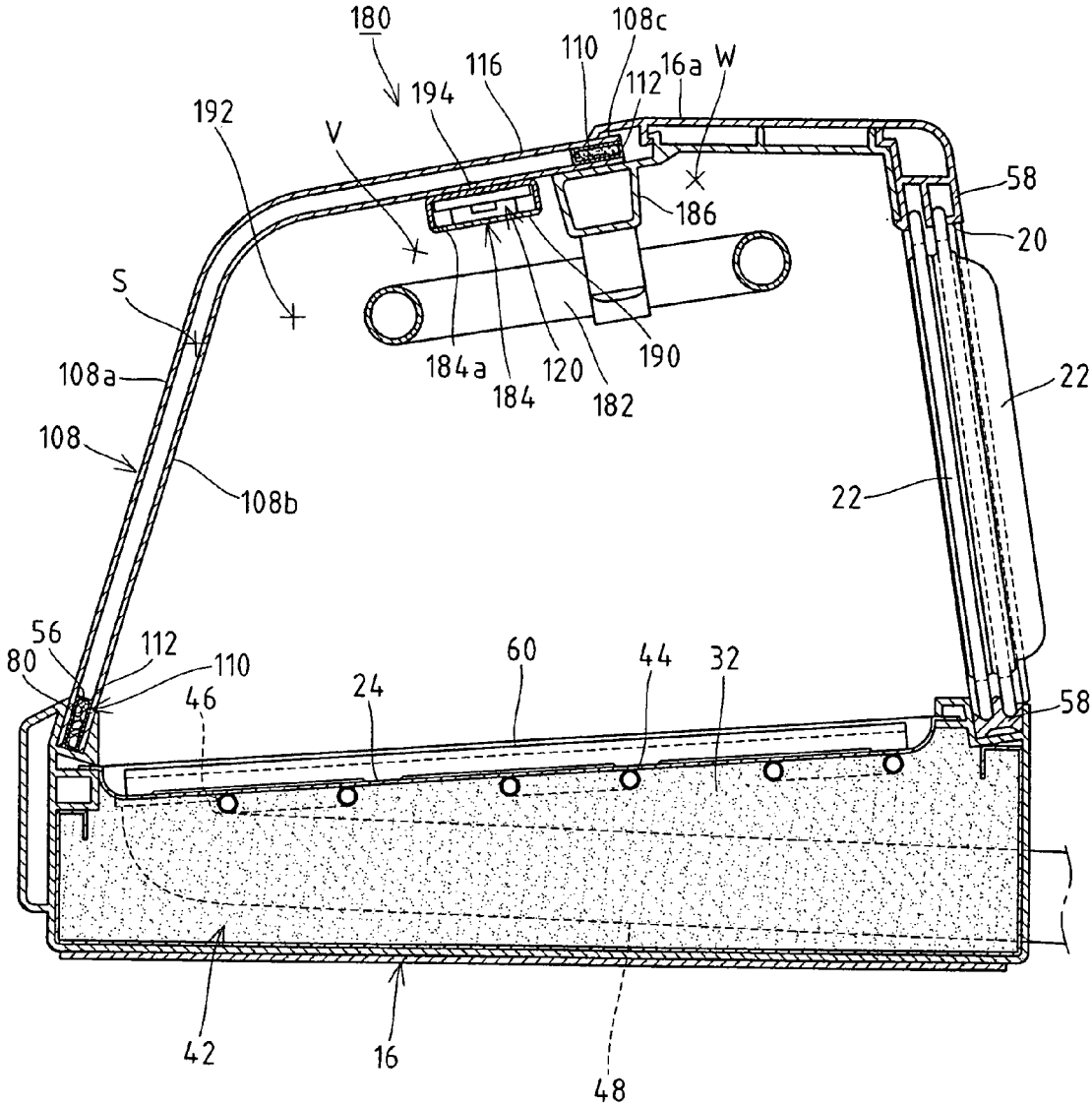
FIG. 14 is a cross-sectional view showing a refrigerated showcase according to a sixth embodiment.
Figure 15:
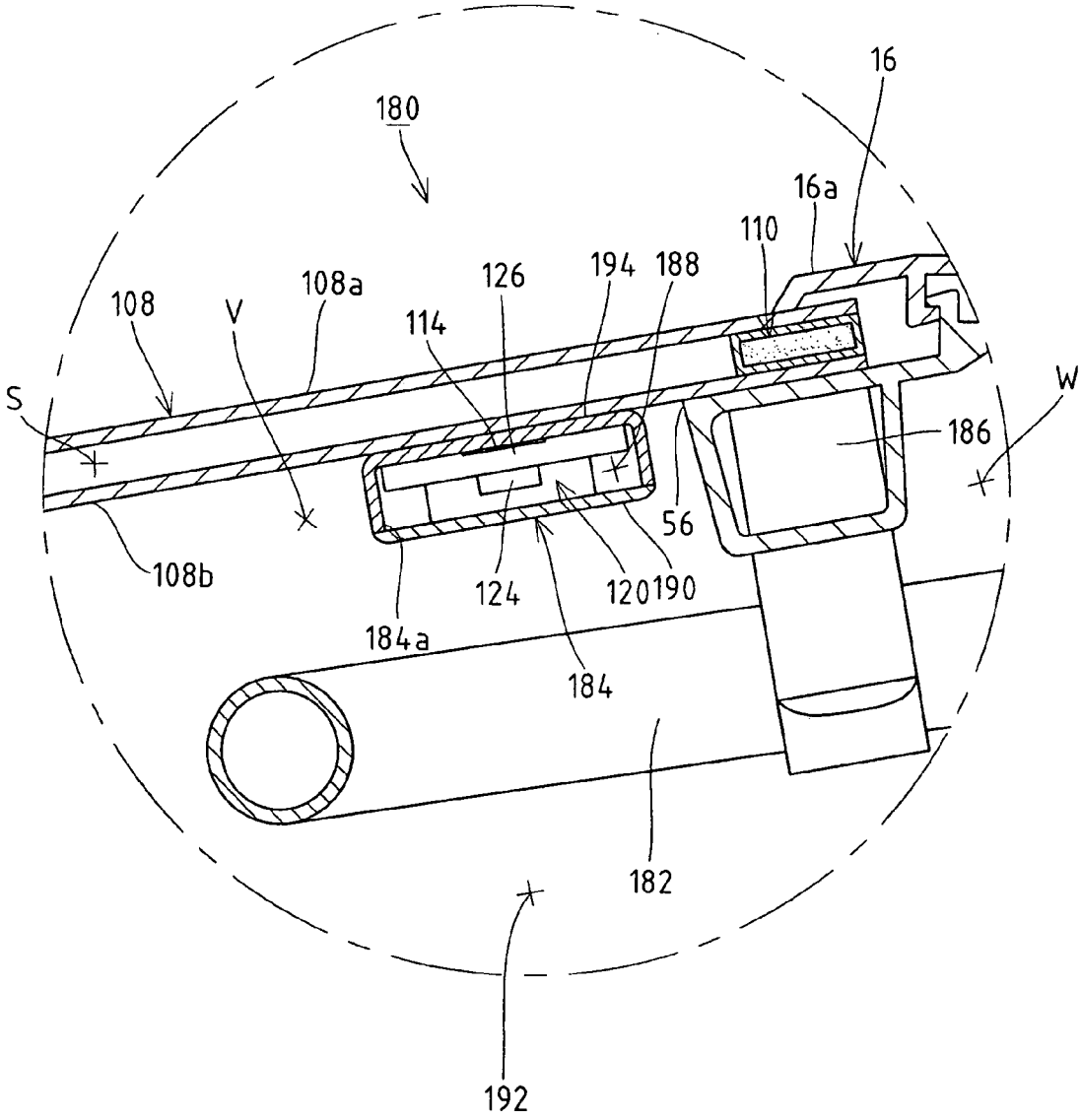
FIG. 15 is an enlarged view showing the essential portion of the refrigerated showcase according to the sixth embodiment.

FIGS. 14 and 15 are diagrams showing a refrigerated showcase 180 according to the sixth embodiment. As shown in FIG. 14, the refrigerated showcase 180 according to the sixth embodiment, unlike those of the first to fifth embodiments, is not of the type which has the evaporator 34 disposed in the upper insulating layer 54, but has a large evaporator 182 provided at the upper portion of a storage room 192 in an exposed state. The LED illumination device 120 is disposed in a holder 184 provided in a free space V between the portion of the front glass 108 which lies above the storage room 192 and the evaporator 182.

That is, as shown in FIG. 14, the evaporator 182 is secured by a mount portion 186 extending downward by a required length from near the upper edge portion 108*c* of the front glass 108, and the required free space V is formed between the evaporator 182 and the front glass 108 positioned thereabove. The holder 184 is provided at that portion of the inner glass 108*b* of the front glass 108 which is close to the mount portion 186, and the LED illumination device 120 is disposed in the holder 184.

As shown in FIG. 15, the holder 184 which receives and holds the LED illumination device 120 has a non-transparent or translucent body portion (frontward and upward portions) 194 with a channel shape in cross section, and an opening 184*a* is open downward of the storage room 192. A receiving space 188 which can receive the LED illumination device 120 is defined inside the body portion 194, and is held in a sealed state by a lid member (portion facing downward) 190 which closes the opening 184*a*. The lid member 190 is formed of a transparent synthetic resin or the like, so that the lights from the LED illumination device 120 are irradiated to the storage room 192 via the lid member 190. That is, those portions of the holder 184 which face at least frontward and upward are formed of a non-transparent or translucent material to prevent the lights from the LED illumination device 120 from being directly irradiated outside, and prevent the substrate 126 or the like of the LED illumination device 120 from being seen from outside. Disposing the holder 184 in the free space V ensure effective use of the space in the storage room 192 without narrowing the space.

As described above, the refrigerated showcase 180 according to the sixth embodiment has the LED illumination device 120 disposed in the free space V between the evaporator 182 and the front glass 108, thereby allowing the space in the storage room 192 to be used effectively without becoming narrower. As the holder 184 is formed of a non-transparent or translucent material, the lights from the LED illumination device 120 will not directly leak outside or the substrate 126 or the like will not be seen from outside. Because the receiving space 188 of the holder 184 is sealed tightly by the lid member 190, the LED illumination device 120 can be prevented from failing due to humidity and adhesion of dust or the like to the LED illumination device 120. Furthermore, the holder 184 can protect the LED illumination device 120 from physical/mechanical shocks.

While the LED illumination device 120 is disposed in the free space V between the evaporator 182 and the front glass 108 in the sixth embodiment, the LED illumination device 120 may be disposed in a free space W between the evaporator 182 and the top cover 28 as shown in FIG. 14.

Although the front glass 18, 108 which has been described in the descriptions of the embodiments and is to be fitted in the front opening 56 of the insulated box body 16 is formed of glass, it may be formed by a member of a synthetic resin such as transparent plastics in place of the front glass 18, 108. Further, the front glass 18, 108 need not be configured by a pair glass in the first and fourth to sixth embodiments, and may be configured by a single glass or plastics or the like.

Although a plurality of LED elements 124 are linearly arranged on the substrate 126 in the third to sixth embodiments and the LED illumination device 120 coupled in series to the substrate 126 is used in the third to sixth embodiments, the LED illumination device 70 of the first and second embodiments can be used in the refrigerated showcase 140, 150, 180. Although the foregoing descriptions of the embodiments have been given of the refrigerated showcase which cools the storage room, the showcase may be of a type which heats the storage room to a predetermined temperature with a heater or the like and store goods in a humidified state.

Further, in a case where reflected lights reflected at the outer and inner glasses 108*a*, 108*b* leak outside when the LED illumination device 120 is activated in the fourth and fifth embodiments, the shield member 198, 200 of the first or second modification of the third embodiment may be provided at the adequate location.

Seventh Embodiment

Next, a refrigerated showcase according to the seventh embodiment will be described below. The above-described first and second modifications of the third embodiment are configured in such a way that the thin-plate like shield member 198 is provided at the outer surface of the outer glass 108*a* or the shield member 200 is provided near the front end portion 122*a* of the holder 122, so that at least the first reflected light $L_1$ among the lights from the LED illumination device 120 which leak outside is shielded. This shields the first reflected light $L_1$ having the highest energy in the reflected lights which lead outside to prevent appearance of the light spot $P_1$ on the front glass 108 caused by the first reflected light $L_1$. That is, the second reflected light $L_2$ and the third reflected light $L_3$ as shown in FIG. 16 are attenuated in the process where the reflected lights $L_2$, $L_3$ repeat reflection in the inner glass 108*b*, so that the light spots $P_2$, $P_3$ which appear on the outer glass 108*a* become less noticeable than the light spot $P_1$ caused by the first reflected light $L_1$, and are allowed to be irradiated outside. In a case where the front glass 108 which is most likely to be seen by customers is demanded of an increasingly improved appearance, however, it is necessary to shield all the first to third reflected lights $L_1$, $L_2$ and $L_3$ of the LED illumination device 120 at the front glass 108 (inner glass 108*b*), thereby preventing appearance of the light spots $P_1$, $P_2$, $P_3$. Accordingly, the refrigerated showcase according to the seventh embodiment employs such a configuration as to scatter the lights from the LED illumination device which are to be reflected at the front glass, thereby preventing the second and third reflected lights $L_2$, $L_3$ from being irradiated outside.

Figure 20:
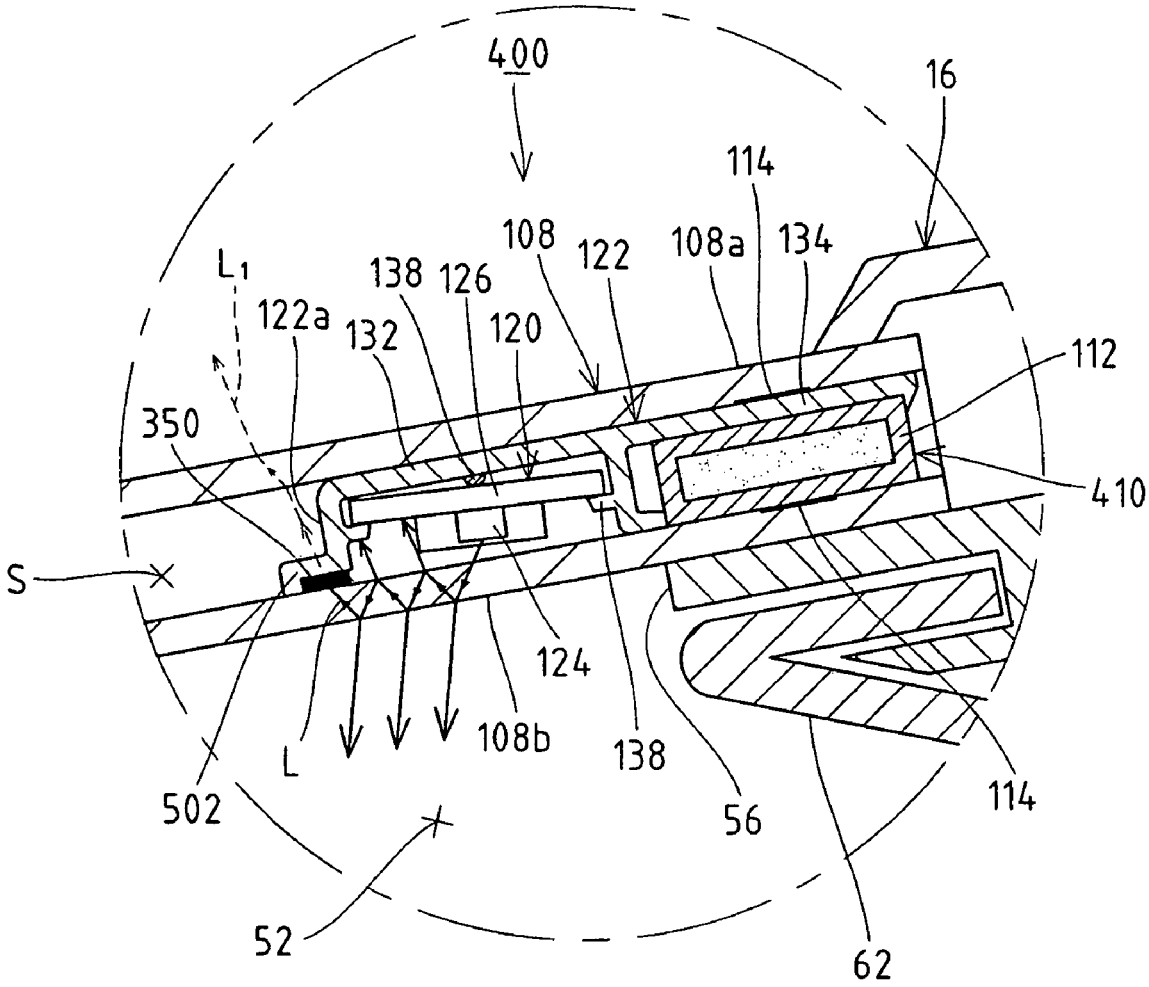
FIG. 20 is an enlarged view showing the essential portion of a refrigerated showcase according to a seventh embodiment.
Figure 21:
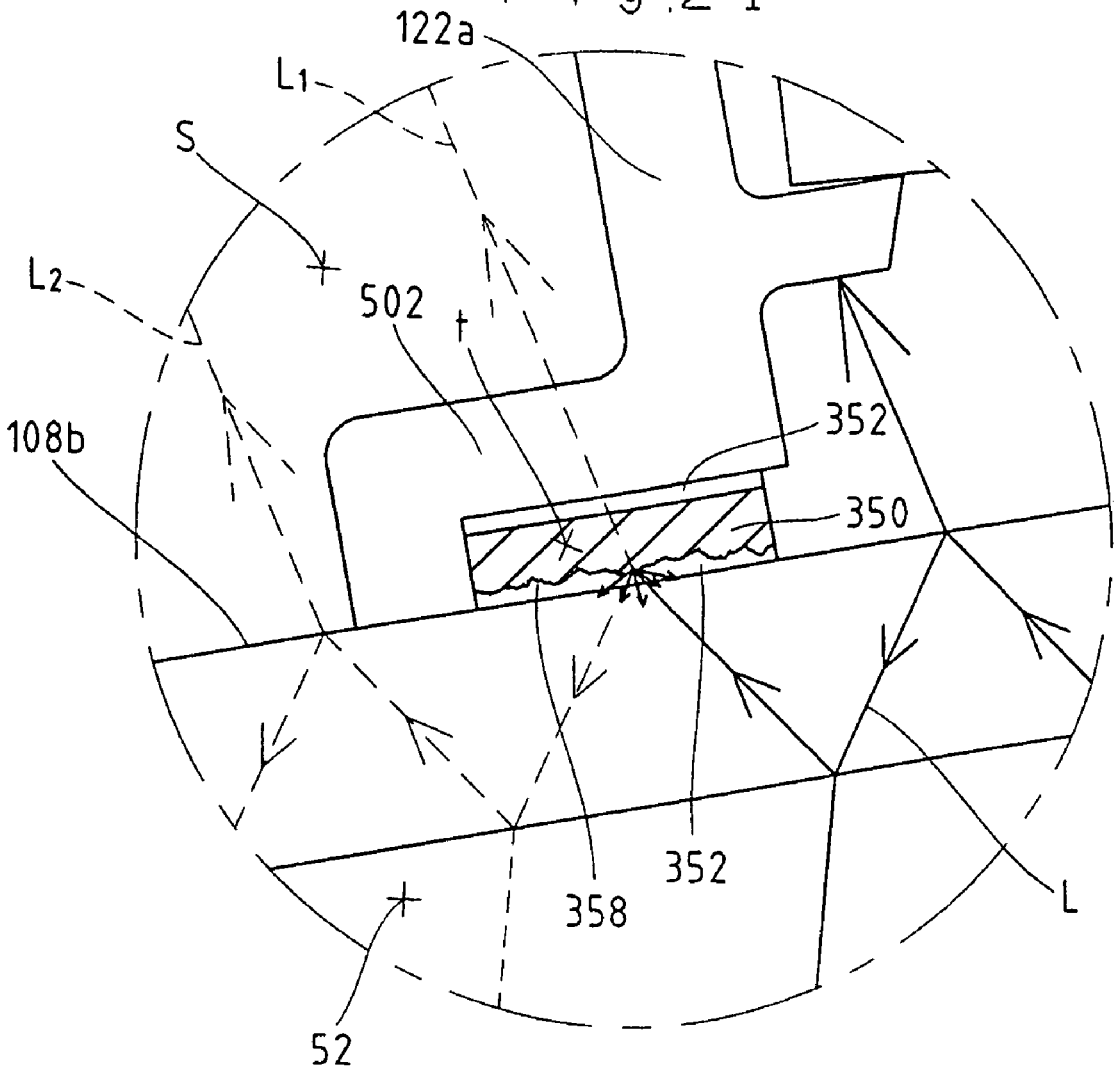
FIG. 21 is an enlarged view showing a shield member adhered to an inner glass.

As shown in FIG. 20, a refrigerated showcase 400 according to the seventh embodiment has basically the same configuration as the refrigerated showcase 140 according to the modifications of the third embodiment, and like reference numerals are given to those members which are of the same types and have the same functions to omit their detailed descriptions. That is, the front glass 108 is a so-called glass having a pair of glasses (transparent plates) 108*a*, 108*b* arranged inside and outside to face each other with a predetermined distance therebetween. The LED illumination device 120 having the LED elements 124 is disposed in the space S defined between the glasses 108*a*, 108*b* by the required holder 122. A hold portion 502 which can receive a shield member 350 to be described later is formed at the space S side portion of the inner glass 108*b* which is opposite to the engagement portion 134 of the holder 122. That is, the hold portion 502 is formed in the space S side surface of the inner glass 108*b* so as to extend frontward from the front end portion 122*a* of the body portion 132 of the holder 122 which is opposite side to the spacer 110. When the LED illumination device 120 is provided in the space S, the hold portion 502 shields the first reflected light $L_1$ (see FIG. 20) among the irradiated lights from the LED illumination device 120 in the inner glass 108*b* which passes closest to the holder 122. Therefore, the length of the frontward extension of the hold portion 502 should be set to the minimum length enough to shield only the first reflected light $L_1$. Further, as shown in FIG. 21, a gap t for receiving the shield member 350 is defined on the inner glass 108*b* side of the hold portion 502 between that side and the inner glass 108*b*.

The shield member 350 is, for example, a tape or the like formed of a non-transparent material, and a transparent adhesive glue (adhesive member) 352 is having a transmissive property is applied to both sides of the shield member 350 to a required thickness. The shield member 350 is retained in the gap t of the hold portion 502 and both sides thereof are adhered to the hold portion 502 and the inner glass 108*b*. That is, as shown in FIG. 21, the outer surface of the shield member 350 is adhered to the hold portion 502 and that surface of the shield member 350 which is on the storage room 52 (adhesive surface to the inner glass 108*b* in the storage) is adhered to the space S side surface of the inner glass 108*b*. Further, a concavoconvex scatter surface 358 is formed on the storage room 52 side surface of the shield member 350 to provide a function of diffusing reflected light L from the LED illumination device 120 reflected at the inner glass 108*b*. That is, as shown in FIG. 21, the reflected light L from the LED illumination device 120 which has repeated reflection in the inner glass 108*b* is diffused in various directions by the scatter surface 358, thereby attenuating the reflected light L. This can prevent the reflected light L from being reflected to the shield member 350 to be the second reflected light $L_2$ and leaking outside the storage room 52, as indicated by a broken arrow in FIG. 21. In other words, the refrigerated showcase 400 according to the seventh embodiment can inhibit outward irradiation of the first reflected light $L_1$ and inhibit outward irradiation of the second and third reflected lights $L_2$, $L_3$ or the like.

Operation Of Seventh Embodiment

Next, the operation of the refrigerated showcase 400 according to the seventh embodiment will be described. When the shield member 350 is attached to the hold portion 502, the adhesive glue 352 is applied to both sides of the shield member 350, and the outer surface of the shield member 350 received in the gap t of the hold portion 502 is adhered to the hold portion 502. Then, that surface of the holder 122 which is above the engagement portion 134 is adhered to the space S side surface of the outer glass 108*a* by the double-coated tape 114, and the LED illumination device 120 is mounted into holder 122. At the same time, the scatter surface 358 of the shield member 350 is adhered to the inner glass 108*b* by the adhesive glue 352, so that the holder 122 and the shield member 350 are secured in the space S.

At the time of activating the LED illumination device 120, the power switch (not shown) of the refrigerated showcase 400 is set ON. Then, the irradiated lights irradiated from the LED illumination device 120 pass through the inner glass 108*b* and illuminate the storage room 52. At this time, as shown in FIG. 20, of the irradiated lights from the LED illumination device 120, there exists the reflected light L which repeats reflection in the inner glass 108*b* and travels frontward of the refrigerated showcase 400. However, the reflected light L is shielded by the shield member 350, so that the first reflected light $L_1$ having the highest energy is prevented from leaking outside as shown in FIG. 20. Further, as the scatter surface 358 of the shield member 350 is formed in a concavoconvex form, when the reflected light L reaches the scatter surface 358, the reflected light L is scattered in various directions as shown in FIG. 21. That is, as the reflected light L is scattered by the scatter surface 358 to be attenuated, preventing the reflected light L from being further reflected by the shield member 350 and leaking outside as the second reflected light $L_2$, as shown in FIG. 21, so that the good appearance of the refrigerated showcase 400 will not be impaired. That is, the first reflected light $L_1$ having the highest energy is shielded by the shield member 350, and the occurrence of the second and the third reflected lights $L_2$, $L_3$ whose outward irradiation is permitted in the refrigerated showcase 140 in the first and second modifications of the third embodiment can be prevented by scattering at the scatter surface 358. What is more, because the adhesive glue 352 present between the shield member 350 and the inner glass 108*b* has a transmissive property, the reflected light L is not reflected by the adhesive glue 352, and can surely reach the scatter surface 358.

In the refrigerated showcase 400 according to the seventh embodiment, as described above, the shield member 350 having the concavoconvex scatter surface 358 formed on the storage room 52 (inner glass 108*b*) side surface, the reflected light L from the LED illumination device 120 which is reflected at the inner glass 108*b* is scattered by the scatter surface 358, and can thus be prevented from leaking outside. Therefore, the appearance of the refrigerated showcase 400 will not be impaired and the interior of the storage room 52 can be viewed clearly from outside. As the adhesive glue 352 which adheres the shield member 350 to the inner glass 108*b* has a transmissive property, the reflected light L is not reflected at the adhesive glue 352 and can surely reach the scatter surface 358 of the shield member 350. As the hold portion 502 which holds the shield member 350 is formed in the holder 122, the shield member 350 is not viewed through the front glass 108 from outside, thus preventing the appearance of the refrigerated showcase 400 from being impaired. The configuration of having the LED illumination device 120 disposed outside the inner glass 108*b* can ensure effective use of the space in the storage room 52 as provided by the effect of the second embodiment.

In the refrigerated showcase 400 according to the seventh embodiment, the shield member 350 is adhered to the inner glass 108*b* with the shield member 350 retained in the hold portion 502 of the holder 122. However, the shield member 350 should not necessarily be retained in the hold portion 502 of the holder 122, and has only to be placed at a position where of the lights from the LED illumination device 120 reflected at the inner glass 108*b*, the first reflected light $L_1$ which passes closest to the LED illumination device 120 is shielded. For example, therefore, the hold portion 502 may not be formed at the holder 122 and the shield member 350 may be adhered to the vicinity of the front end portion 122*a* of the holder 122. Although the LED illumination device 120 is disposed in the space S of the front glass 108 via the holder 122 in the seventh embodiment, the LED illumination device 120 should not necessarily be supported by the holder 122, and may be mounted directly to the front glass 108. Further, although the foregoing description of the seventh embodiment has been given of the case where a tape is used as the shield member 350, the shield member may be formed by any thin-plate member which can shield reflected light, e.g., plastics. While the adhesive glue 352 is used as an adhesive member in the seventh embodiment, it may be changed to another adhesive material, such as an adhesive, which has a transmissive property. Further, although the shield member and the adhesive glue are structured as separate members in the seventh embodiment, a member which has the shield member and the adhesive glue (adhesive) integrated previously, such as a double-coated tape or the like which can shield light, can be used.

While the seventh embodiment employs a pair glass having a pair of glasses 108*a*, 108*b* as a transparent member, the transparent member may be constituted by a single glass (transparent plate). In this case, the illumination device and the shield member are mounted to the outside the single glass (outside the storage room 52). The transparent plate can be formed of transparent plastics or the like. Although the description of the seventh embodiment has been given, by way of an example, of the refrigerated showcase 400 which cools the interior of the storage room 52, various showcases with other configurations are adaptable, such as a showcase which heats the storage room 52 to a predetermined temperature by a heater or the like and stores goods in a heated state.

Figure 22:
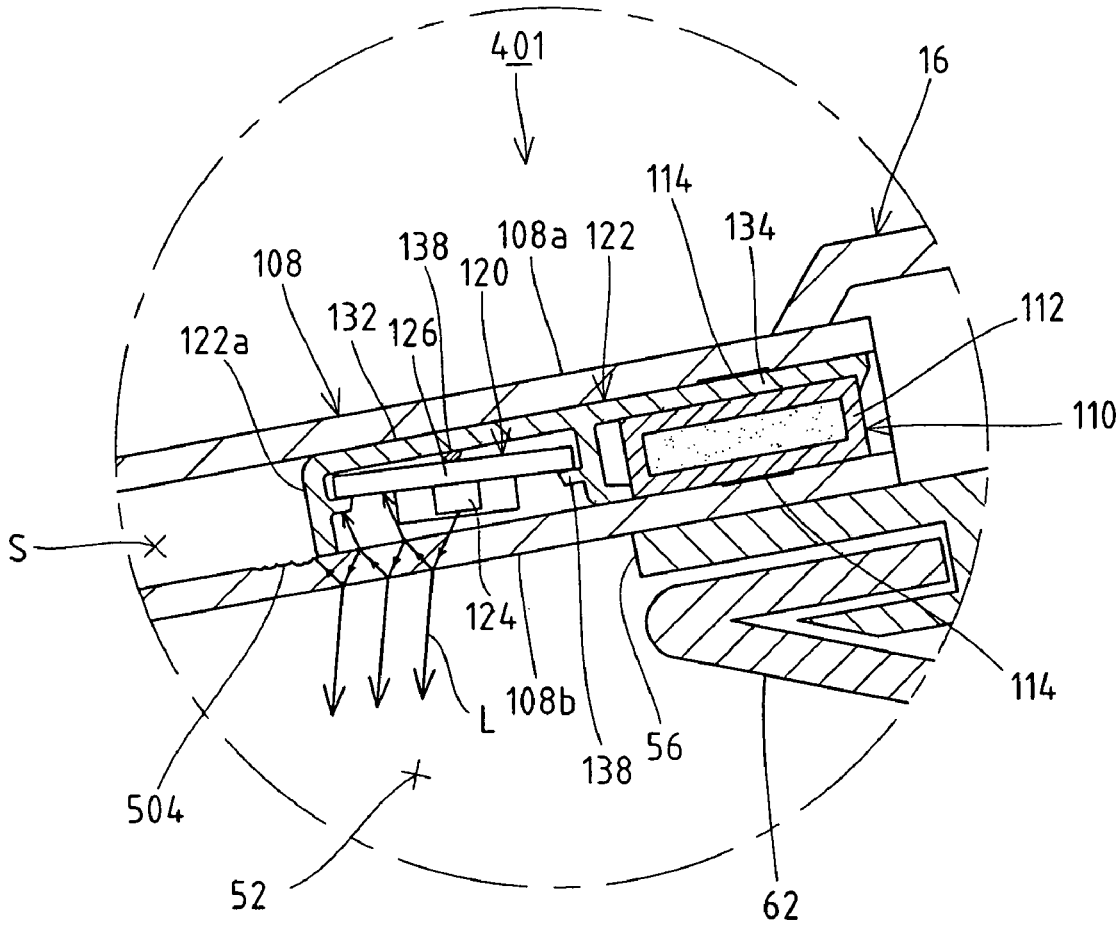
FIG. 22 is an enlarged view showing the essential portion of a refrigerated showcase according to a modification of the seventh embodiment.
Figure 23:
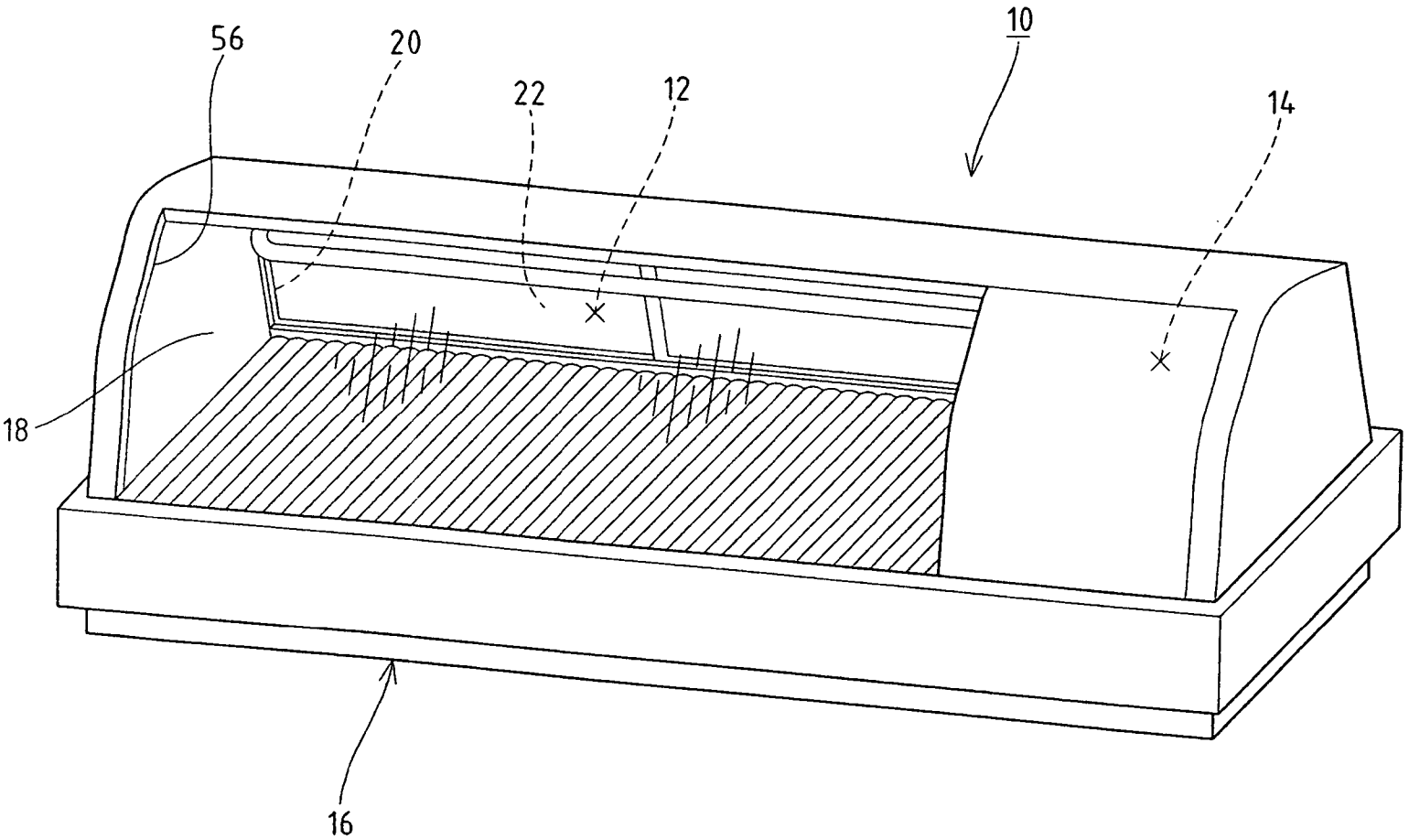
Fig.23 [Prior Art]
FIG. 23 is a general perspective view showing the conventional refrigerated showcase.
Figure 24:
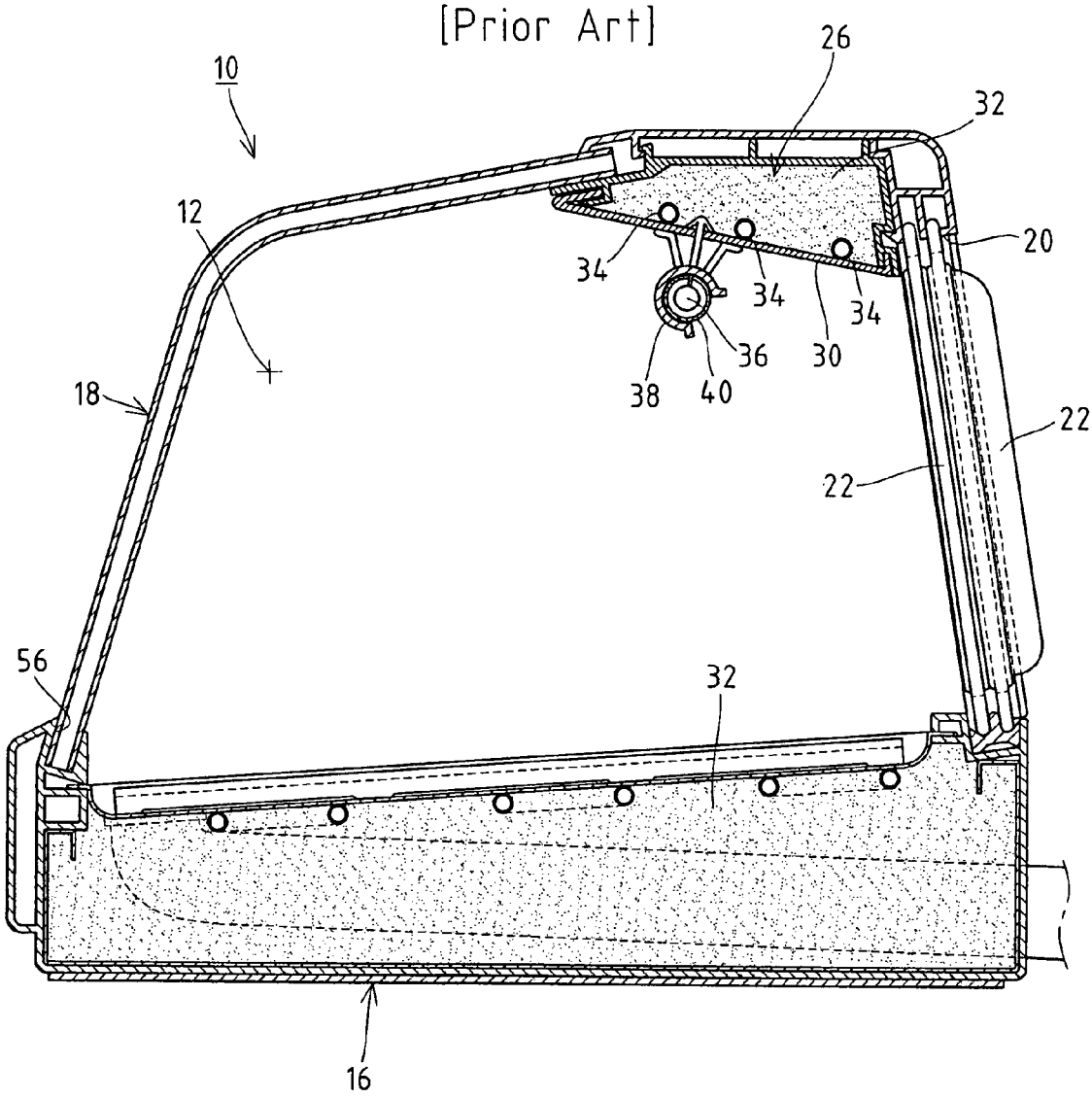
Fig.24 [Prior Art]
FIG. 24 is a cross-sectional view of the refrigerated showcase shown in FIG. 23.

A showcase 401 shown in FIG. 22 is given as a configuration which has functions and effects similar to those of the refrigerated showcase according to the seventh embodiment. The showcase 401 employs the holder 122 of the seventh embodiment from which the hold portion 502 is omitted, and irregular abrasions are provided near the front end portion 122*a* of the inner glass 108*b* on the space S side. The irregular abrasive surface 504 serves as the scatter surface 358 of the seventh embodiment so that the irregular surface 504 scatters the reflected light L of the LED illumination device 120 reflected at the inner glass 108*b*. This attenuates the reflected light L of the LED illumination device 120 reflected at the inner glass 108*b*, and suppresses leakage of strong light outside.

What is claimed is:

1. A showcase in which a storage room (192) to store goods is defined inside an insulated box body (16) having a transparent member (108) fitted into a front opening (56) thereof and the temperature of the storage room (192) is adjusted, and an LED illumination device (120) having an LED element (124) mounted on a substrate (126) is provided at the insulated box body (16) to illuminate inside the storage room (192), wherein an evaporator (182) is disposed at an inside upper portion of the storage room (192) via a mount portion (186) provided on a ceiling surface of the storage room (192) in such a way as to be spaced apart from the ceiling surface and a rear surface of the storage room (192) by a required distance, and the LED illumination device (120) is provided on the ceiling surface and is arranged in a space (V) between the ceiling surface of the storage room (192) and the evaporator (182) so that the LED illumination device (120) is located directly above a space defined by inner edges of the evaporator (182).

2. The showcase according to claim 1, wherein the LED illumination device (120) is retained and held, with the LED element (124) facing toward the storage room (192), in a holder (184) to which light is transmittable from a side facing the storage room (192).

3. The showcase according to claim 2, wherein the holder (184) is provided between said evaporator (182) and said transparent member (108) which is provided above the evaporator (182), and said holder (184) has a non-transparent or translucent portion (194) facing at least a front side or an upper side.

4. The showcase according to claim 1, wherein the evaporator is spaced apart from a rear surface of the storage room by a predetermined distance and the LED illumination device (120) is provided on the ceiling surface.

* * * * *